US006492079B2

(12) United States Patent
Shimada et al.

(10) Patent No.: US 6,492,079 B2
(45) Date of Patent: Dec. 10, 2002

(54) ELECTROPHOTOGRAPHIC PHOTOCONDUCTOR, IMAGE FORMING APPARATUS, AND PROCESS CARTRIDGE USING THE PHOTOCONDUCTOR

(75) Inventors: Tomoyuki Shimada, Shizuoka (JP); Kazukiyo Nagai, Shizuoka (JP); Chiaki Tanaka, Shizuoka (JP); Michihiko Namba, Kanagawa (JP); Shinichi Kawamura, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/817,151

(22) Filed: Mar. 27, 2001

(65) Prior Publication Data

US 2002/0028400 A1 Mar. 7, 2002

(30) Foreign Application Priority Data

| | | |
|---|---|---|
| Mar. 28, 2000 | (JP) | 2000-088446 |
| Jul. 10, 2000 | (JP) | 2000-208846 |
| Oct. 12, 2000 | (JP) | 2000-312336 |

(51) Int. Cl.[7] ..... G03G 13/04; G03G 15/22

(52) U.S. Cl. ..... 430/58.05; 399/220

(58) Field of Search ..... 430/58.05, 58.35; 399/220

(56) References Cited

U.S. PATENT DOCUMENTS

| | | | | | |
|---|---|---|---|---|---|
| 5,670,291 | A | * | 9/1997 | Ward et al. | 430/132 |
| 5,717,626 | A | * | 2/1998 | Aoki et al. | 365/112 |
| 6,132,913 | A | * | 10/2000 | Fuller et al. | 430/59 |

* cited by examiner

*Primary Examiner*—John Goodrow
(74) *Attorney, Agent, or Firm*—Oblon, Spivak, McClelland, Maier & Neustadt, P.C.

(57) ABSTRACT

An electrophotographic photoconductor has an electroconductive support, and a charge generation layer and a charge transport layer successively formed on the electroconductive support, the charge transport layer allowing any monochromatic light with a wavelength in a wavelength region of 390 to 460 nm to pass through and exhibiting a fluorescence generation coefficiency of 0.8 or less when irradiated with the monochromatic light. An electrophotographic image forming apparatus and a process cartridge employ the above-mentioned photoconductor.

17 Claims, 7 Drawing Sheets

ELECTROPHOTOGRAPHIC PHOTOCONDUCTOR, IMAGE FORMING APPARATUS, AND PROCESS CARTRIDGE USING THE PHOTOCONDUCTOR

BACKGROUND OF THE INVENTION

1. Field of the Invention

The present invention relates to an electrophotographic photoconductor in which a charge generation layer and a charge transport layer are successively provided on an electroconductive support. In addition, the present invention relates to an electrophotographic image forming apparatus using the above-mentioned photoconductor and a light source with a wavelength in the range of 400 to 450 nm as a light exposure means for data recording. The present invention also relates to a process cartridge including the photoconductor, which process cartridge is freely attachable to the image forming apparatus and detachable therefrom.

2. Discussion of Background

It is well known that a photoconductor for use with an electrophotographic process employs a photoconductive material, which is divided into an inorgnaic photoconductive material and an organic photoconductive material.

According to the above-mentioned electrophotographic process, image formation is usually achieved by following the procedures shown below. The surface of a photoconductor is uniformly charged in the dark, for example, by corona charging, and exposed to light images to selectively dissipate electric charge of a light-exposed portion, thereby forming latent electrostatic images on the surface of the photoconductor. The latent electrostatic images are developed as visible toner images with a toner that is made up of a coloring agent, such as a dye or pigment, and a polymeric material. Image formation can thus be repeated, using the photoconductor, by the so-called Carlson process, for an extended period of time.

Most of the currently available photoconductors employ organic photoconductive materials. This is because an organic photoconductive material is superior to an inorganic material in terms of the degree of freedom in selection of wavelength of light to which the photoconductive material is sensitive, the filming forming properties, flexibility, transparency of the obtained film, mass productivity, toxicity, and cost.

The photoconductor repeatedly used in the electrophotographic process or the like is required to have basic electrostatic properties such as good sensitivity, sufficient charging potential, charge retention properties, stable charging characteristics, minimal residual potential, and excellent spectral sensitivity.

In recent years, data processors employing the electrophotographic process have exhibited remarkable development. The image quality and printing reliability have noticeably improved, in particular, in the field of a printer that adapts a digital recording system by which information is converted into a digital signal and recorded by means of light. Such a digital recording system is applied to not only printers, but also to copying machines. Namely, a digital copying machine has been actively developed. Further, there is a tendency for the digital copying machine to be provided with various data processing functions, so that demand for the digital copying machine is expected to rise sharply.

A function-separation layered photoconductor has become the mainstream in the field of electrophotographic photoconductors for the above-mentioned digital copying machine. The function-separation layered photoconductor is constructed in such a manner that a charge generation layer and a charge transport layer are successively overlaid on an electroconductive support. To improve the durability of the photoconductor from the mechanical and chemical viewpoints, a surface protection layer may be overlaid on the top surface of the photoconductor.

When the surface of the function-separation layered photoconductor is charged and thereafter exposed to light images, the light passes through the charge transport layer and is absorbed by a charge generation material in the charge generation layer. Upon absorbing light, the charge generation material produces a charge carrier. The charge carrier is injected into the charge transport layer and travels along an electric field generated by the charging step to neutralize the surface charge of the photoconductor. As a result, latent electrostatic images are formed on the surface of the photoconductor.

In view of the above-mentioned mechanism of the function-separation layered photoconductor, a charge generation material which exhibits absorption peaks within the range from the near infrared region to the visible light region is often used in combination with a charge transport material that does not hinder the charge generation material from absorbing light, in other words, exhibiting absorption within the range from the visible light region (yellow light region) to the ultraviolet region.

As a light source capable of coping with the above-mentioned digital recording system, a semiconductor laser diode (LD) and a light emitting diode (LED), which are compact, inexpensive, and highly reliabler are widely employed. The LD most commonly used these days has an oscillation wavelength range in the near infrared region of around 780 to 800 nm. The emitting wavelength of the typical LED is located at 740 nm.

Recently, an LD or LED with oscillation wavelengths of 400 to 450 nm to emit a violet or blue light has been developed and finally put on the market as a light source for writing information so as to cope with the digital recording system. This kind of LD or LED is hereinafter referred to as "shorter wavelength LD or LED." In the case where a shorter wavelength LD, of which the oscillation wavelength is as short as nearly half the conventional one located in the near infrared light region, is used as the light source for writing, it is theoretically possible to decrease the spot size of a laser beam projected on the surface of a photoconductor, in accordance with the following formula (A):

$$d=(\pi/4)(\lambda f/D) \qquad (A)$$

wherein d is the spot size projected on the surface of the photoconductor, $\lambda$ is the wavelength of the laser beam, f is the focal length of a f$\theta$ lens, and D is the lens diameter.

In other words, the use of the shorter wavelength LD or LED can enormously contribute to improvement of the recording density, that is, resolution, of a latent electrostatic image formed on the photoconductor.

Further, for the use of such a shorter wavelength LD or LED, it will be possible to make the electrophotographic image forming apparatus compact as a whole, and to speed up the electrophotographic image forming method. Accordingly, there is an increasing demand for high sensitivity and high stability of the electrophotographic photoconductor so as to cope with the light source of the LD or LED having wavelengths of about 400 to 450 nm.

As previously mentioned, the function-separation layered photoconductor has been the mainstream of the electrophotographic photoconductors. With such a layered structure, the charge transport layer is usually overlaid on the charge generation layer. High sensitivity can be obtained if light emitted from the shorter wavelength LD or LED can efficiently reach the charge generation layer after passing through the charge transport layer. Namely, it becomes important that the charge transport layer not absorb the light from the LD or LED.

The charge transport layer is generally a film with a thickness of about 10 to 30 $\mu$m made from a solid solution in which a low-molecular weight charge transport material is dispersed in a binder resin. Most of the currently available photoconductors employ as a binder resin for the charge transport layer a bisphenol polycarbonate resin or a copolymer consisting of a monomer of the above-mentioned polycarbonate resin and any other monomers. The bisphenol polycarbonate resin has the characteristics that no absorption appears in the wavelength range from 390 to 460 nm. Therefore, the bisphenol polycarbonate resin does not severely hinder the light for a recording operation from passing through the charge transport layer.

The following are commercially available charge transport materials that are conventionally known: 1,1-bis(p-diethylaminophenyl)-4,4-diphenyl-1,3-butadiene (Japanese Laid-Open Patent Application 62-30255), 5-[4-(N,N-di-p-tolylamino)benzylidene]-5H-dibenzo[a,b]cyclo-heptene (Japanese Laid-Open Patent Application 63-225660), and pyrene-1-aldehyde 1,1-diphenylhydrazone (Japanese Laid-Open Patent Application 58-159536). These conventional charge transport materials exhibit absorption in the wavelength range of 390 to 460 nm. Therefore, the light emitted from the above-mentioned shorter wavelength LD or LED is unfavorably absorbed in a surface portion of the charge transport layer. As a result, the light cannot reach the charge generation layer, whereby the photosensitivity cannot be obtained in principle.

Japanese Laid-open Patent Applications 55-67778 and 9-190054 state that when light with a particular wavelength which will be absorbed by the charge transport material is used, a decrease in charging characteristics and an increase in residual potential are caused during repeated operations. Light absorption by the charge transport material lowers the photosensitivity, and in addition, has an adverse effect on the fatigue behavior in the repetition.

There are some charge transport layers that can exhibit high sensitivity when used in the layered photoconductor although the short-wavelength light can hardly pass through those charge transport layers. The mechanism of this phenomenon is disclosed in Japanese Laid-Open Patent Application 5-61216 and Japan Hard Copy '91, p. 165. Namely, when the charge transport material absorbs light that is projected on the photoconductor for data recording, the behavior of the charge transport material is as follows: after the charge transport material is first optically excited, the charge transport material fluoresces light of which wavelength is longer than the light projected on the charge transport layer, and thereafter the charge transport material becomes inactivated. The fluorescence emitted from the charge transport material is partially dissipated from the surface of the photoconductor, but mostly trapped in the photoconductor. The fluorescence trapped in the photoconductor repeatedly causes multiple reflection in the photoconductive layer until the fluorescence is absorbed by a charge generation material. Further, unfavorably, such fluorescence occurs in a surface portion of the charge transport layer, and light advances in every direction. The result is that a latent image formed on the photoconductor shows a decreased resolution, thereby inducing image blur.

It is known that light absorption by the charge transport material has an adverse effect not only on the sensitivity, but also the fatigue characteristics caused by repeated operations and the resolution of a latent image. Japanese Laid-Open Patent Application 12-105471 discloses an electrophotographic photoconductor that can cope with a light exposure means using a light source with a short wavelength. A charge transport layer of the photoconductor exhibits light transmitting properties of 30% or more with respect to the above-mentioned light with short wavelengths. Such high light transmitting properties of the charge transport layer can effectively increase the sensitivity of the photoconductor. However, in the case where the charge transport layer shows not only high light transmitting properties, but also a large fluorescence generation efficiency, the resolution of latent images formed on the photoconductor is lowered, as previously mentioned. Most of the charge transport materials disclosed in the above-mentioned application considerably absorb light projected on the photoconductor for the formation of latent images, so that there is a serious problem in the repetition stability.

Japanese Laid-Open Patent Application 12-89492 discloses the use of a charge transport material with a quantum yield of 0.1 or more. Disadvantageously, however, the resolution of latent images formed on the photoconductor is similarly lowered.

Japanese Laid-Open Patent Application 9-240051 discloses an electrophotographic image forming apparatus which employs as a light source an LD beam With an oscillation wavelength of 400 to 500 nm. An electrophotographic photoconductor for use in the above-mentioned image forming apparatus is constructed in such a manner that a charge transport layer and a charge generation layer are successively overlaid on an electroconductive support in that order to aim at high resolution of the obtained image. However, the charge generation layer in the form of a fragile thin film is exposed to mechanical and chemical hazards in the cycle of charging, development, image transfer, and cleaning steps. The photoconductor deteriorates too badly to be used in practice.

The above-mentioned Japanese Laid-Open Patent Application 9-240051 also discloses an electrophotographic photoconductor of a single-layered structure, This kind of photoconductor has the problems that design of the constituent materials is limited and the sensitivity cannot increase as high as that of the function-separation layered photoconductor.

In the field of the electrophotographic image forming apparatus such as printers and copying machines, the diameter of a photoconductor tends to decrease in line with the development of high-speed operation, small-size apparatus, and high-quality image formation. This tendency makes the operating conditions of the photoconductor much more severe in the electrophotographic process.

For example, a charging roller and a cleaning rubber blade are disposed around the photoconductor. An increase in hardness of the rubber and an increase in contact pressure of the rubber blade with the photoconductor become unavoidable to obtain adequate cleaning performance. As a result, the photoconductor suffers from wear, and therefore, the potential and the sensitivity of the photoconductor are always subject to variation. Such variation produces abnormal images, impairs the color balance of color images, and lowers the color reproducibility.

In addition, when the photoconductor is operated for a long period of time, ozone generated in the course of the charging step oxidizes a binder resin and a charge transport material. Further, ionic compounds such as nitric acid ion, sulfuric acid ion, and ammonium ion, and organic acid compounds generated in the charging step are accumulated on the surface of the photoconductor, which will lead to great deterioration of image quality.

In light of the above, it is considered important to upgrade the durability of the photoconductor and improve the physical properties of the top surface layer of the photoconductor.

SUMMARY OF THE INVENTION

It is therefore a first object of the present invention to provide an electrophotographic photoconductor which can exhibit high sensitivity to a light source such as a laser diode (LD) or light emitting diode (LED) with a wavelength in the range of 400 to 450 nm, and excellent stability during the repeated operations.

A second object of the present invention is to provide a process cartridge holding therein the above-mentioned photoconductor.

A third object of the present invention is to provide an electrophotographic image forming apparatus including the above-mentioned photoconductor.

The first object of the present invention can be achieved by an electrophotographic photoconductor comprising an electroconductive support, a charge generation layer formed thereon, and a charge transport layer formed on the charge generation layer, the charge transport layer allowing any monochromatic light with wavelengths of 390 to 460 nm to pass, and the charge transport layer exhibiting a fluorescence generation efficiency of 0.8 or less when irradiated with the above-mentioned monochromatic light.

The second object of the present invention can be achieved by a process cartridge which is freely attachable to an electrophotographic image forming apparatus and detachable therefrom, the process cartridge holding therein the above-mentioned electrophotographic photoconductor, and at least one means selected from the group consisting of a charging means for charging a surface of the photoconductor, a light exposure means for exposing the photoconductor to a light image to form a latent electrostatic image on the photoconductor, a development means for developing the latent electrostatic image to a visible image, an image transfer means for transferring the visible image formed on the photoconductor to an image receiving member, a cleaning means for cleaning the surface of the photoconductor, and a quenching means.

The third object of the present invention can be achieved by an electrophotographic image forming apparatus comprising the above-mentioned electrophotographic photoconductor, means for charging a surface of the photoconductor, means for exposing the photoconductor to a light image to form a latent electrostatic image on the photoconductor, means for developing the latent electrostatic image to a visible image, and means for transferring the visible image formed on the photoconductor to an image receiving member.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

As a light source for writing latent images on the surface of an electrophotographic photoconductor (hereinafter referred to as a photoconductor), an LD or LED with wavelengths of 400 to 450 nm is employed.

Such an LD or LED with wavelengths of 400 to 450 nm exhibits a remarkably narrow light emitting wavelength distribution, but the distribution may be shifted toward a shorter wavelength side or a longer wavelength side by several nanometers depending upon the ambient temperature and production lot. In consideration of the above-mentioned point, it is preferable that a charge transport layer for use in the present invention allow light with wavelengths of 390 to 460 nm to pass through. Since the light emitting wavelength distribution of such an LD or LED is very narrow, it is not necessary that the charge transport layer transmit light throughout the entire wavelength region of the above-mentioned LD or LED. Namely, it is preferable that only one desired monochromatic light within the wavelength region of 390 to 460 nm pass through the charge transport layer. In this case, it is desirable that the light transmitting properties of the charge transport layer, which will be described in detail with reference to FIG. 1, be 50% or more, and more preferably 90% or more, when the charge transport layer is irradiated with the above-mentioned monochromatic light.

In practice, the charge transport layer is incorporated in a drum- or sheet-shaped photoconductor. Therefore, with the manufacturing conditions being taken into consideration, the charge transport layer does not form a plane surface and is not provided with complete surface smoothness. As a result, the amount of light entering the charge transport layer is necessarily decreased because of light scattering and light reflection by the surface of the charge transport layer. The above-mentioned light transmitting properties defined in the present invention simply mean the light obtained by subtracting the light scattered and reflected by the charge transport layer from the total amount of light entering the charge transport layer. In other words, a ratio of light volume obtained after passing through the charge transport layer to light volume of incident light to the charge transport layer.

Figure 1:
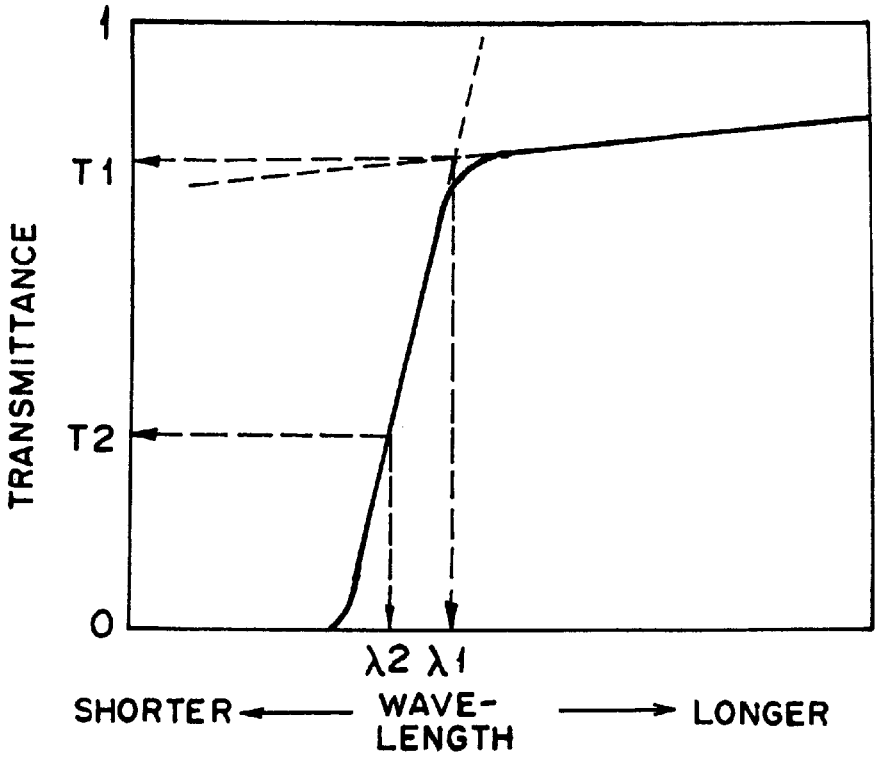
FIG. 1 is a transmission spectrum of a charge transport layer for use in an electrophotographic photoconductor, in explanation of the light transmitting properties of the charge transport layer.

FIG. 1 is a transmission light spectrum of a charge transport layer. The charge transport layer exhibits such a transmission spectrum as in FIG. 1 when the charge transport layer is irradiated with light with wavelengths of 390 to 460 nm. For example, when a light source employs a monochromatic light of a wavelength λ2 (nm) in an electrophotographic image forming apparatus, the light transmitting properties of the charge transport layer with respect to the monochromatic light having a wavelength λ2 can be obtained in accordance with the following formula (B):

$$\text{Light Transmitting Properties } (\%) = T_2/T_1 \times 100 \qquad (B)$$

wherein $T_1$ is the transmittance at a wavelength λ1 which is longer than the wavelength λ2, provided that a value of $T_1$ shows a maximum transmittance in the wavelength region of 390 to 460 nm; and $T_2$ is the transmittance at the wavelength λ1.

Figure 2:
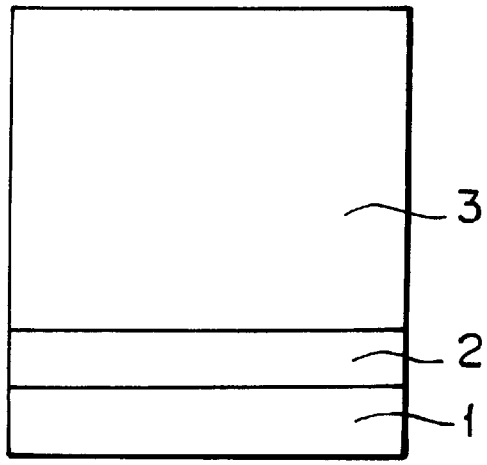
FIG. 2 is a schematic cross-sectional view of a first embodiment of an electrophotographic photoconductor according to the present invention.
Figure 3:
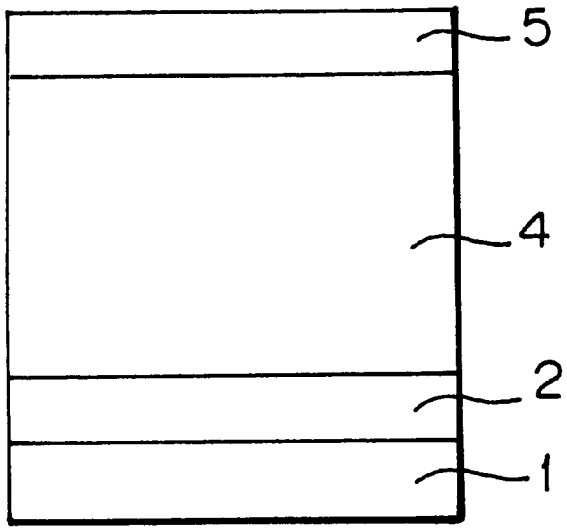
FIG. 3 is a schematic cross-sectional view of a second embodiment of an electrophotographic photoconductor according to the present invention.
Figure 4:
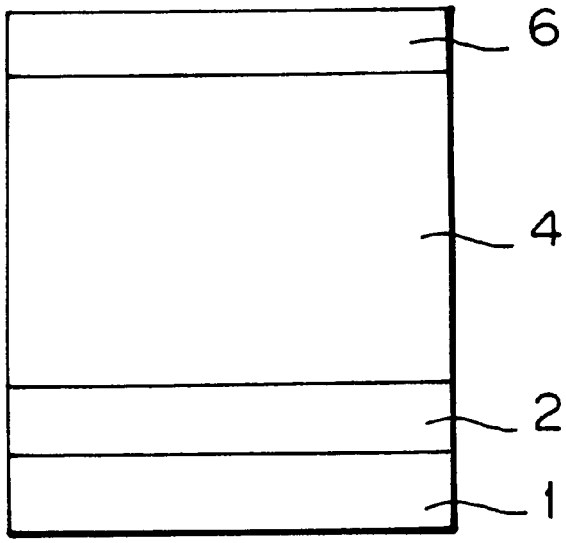
FIG. 4 is a schematic cross-sectional view of a third embodiment of an electrophotographic photoconductor according to the present invention.

FIG. 2 to FIG. 4 are cross sectional views showing embodiments of the electrophotographic photoconductor according to the present invention.

Referring to FIG. 2, there is shown an enlarged cross-sectional view of a first embodiment of an electrophotographic photoconductor according to the present invention. In the figure, a charge generation layer 2 and a charge transport layer 3 are successively overlaid on an electroconductive support 1. The charge generation layer 2 contains a charge generation material 3 as the main component, while the charge transport layer 3 comprises a charge transport material, with a filler being optionally added thereto.

A photoconductor of FIG. 3 is constructed in such a manner that a charge generation layer 2, a first charge transport layer 4 comprising as the main component a charge transport material, and a second charge transport layer 5 comprising a binder resin and a filler such as a powdered high-molecular weight charge transport material are successively provided on an electroconductive support 1 in that order.

In a photoconductor shown in FIG. 4, a charge generation layer 2, a first charge transport layer 4 comprising as the main component a charge transport material, and a second charge transport layer 6 comprising a charge transport material and a filler are successively overlaid on an electroconductive support 1.

In FIG. 2 to FIG. 4, the charge generation layer 2, the charge transport layer 3, the first charge transport layer 4, and the second charge transport layers 5 and 6 may further comprise a binder resin to improve the dispersion properties of a coating liquid for formation of each layer and increase the strength of the obtained layer. In any of the photoconductors shown in FIG. 2 to FIG. 4, an undercoat layer (not shown) may be interposed between the electroconductive support 1 and the charge generation layer 2. The provision of the undercoat layer is for improving the charging characteristics of the photoconductor, increasing the adhesion between the electroconductive support 1 and the charge generation layer 2, and preventing the occurrence of Moiré caused by coherent beams of light such as a laser beam for data recording.

According to the present invention, the charge transport layer 3 in FIG. 2, the combination of the first charge transport layer 4 and the second charge transport layer 5 in FIG. 3, and the combination of the first charge transport layer 4 and the second charge transport layer 6 in FIG. 4 are designed to transmit any of monochromatic light with wavelengths of 390 to 460 nm. Therefore, when a binder resin is contained in any of the above-mentioned layers, the binder resin is required to transmit the light with the same wavelengths as mentioned above. For example, the following thermoplastic resins and thermosetting resins are preferably used: polystyrene, styrene—acrylonitrile copolymer, styrene—butadiene copolymer, styrene—maleic anhydride copolymer, polyester, poly(vinyl chloride), vinyl chloride—vinyl acetate copolymer, poly(vinyl acetate), poly (vinylidene chloride), polyallylate, phenoxy resin, polycarbonate resin, cellulose acetate resin, ethyl cellulose resin, poly(vinyl butyral), poly(vinyl formal), poly(vinyltoluene) poly-N-vinylcarbazole, acrylic resin, silicone resin, epoxy resin, melamine resin, urethane resin, phenolic resin, and alkyd resin.

In particular, a binder resin represented by the following formula (1) or (2), and a mixture of the binder resins of formulas (1) and (2) are preferably used for the charge transport layer:

(1)

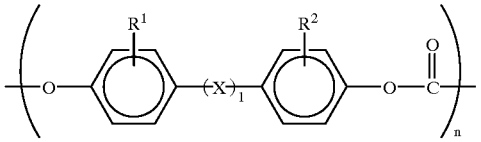

-continued (2)

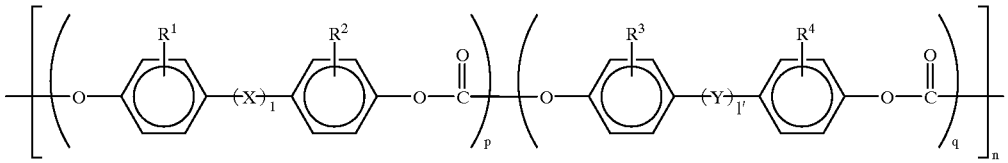

wherein $R^1$, $R^2$, $R^3$, and $R^4$ are each independently a hydrogen atom, a substituted or unsubstituted alkyl group having 1 to 12 carbon atoms, preferably 1 to 6 carbon atoms, a halogen atom, a substituted or unsubstituted aryl group having 6 to 12 carbon atoms, or an arylalkyl group having 7 to 12 carbon atoms; p and q represent composition ratios, and $0.1 \leqq p \leqq 1$ and $0 \leqq 1 \leqq 0.9$; n is an integer of 5 to 5000, which represents the number of repeat units; l and l' are each an integer of 0 or 1; and when l=1 and l'=1, X and Y are each a bivalent aliphatic group, a bivalent alicyclic group, —O—, —S—, —SO—, —$SO_2$—, —CO—, —CO—O—Z—O—CO— in which Z is a bivalent aliphatic group, or a bivalent group represented by the following formula (3):

(3)

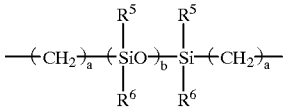

in which a is an integer of 1 to 20; b is an integer of 1 to 2,000; and $R^5$ and $R^6$, which may be the same or different, are each independently a substituted or unsubstituted alkyl group having 1 to 12 carbon atoms, preferably 1 to 6 carbon atoms, a substituted or unsubstituted aryl group having 6 to 12 carbon atoms, or an arylalkyl group.

The bivalent aliphatic group represented by X, Y, and Z in formulas (1) and (2) includes an alkylene group having 1 to 12 carbon atoms and an oxyalkylene group. The bivalent alicyclic group represented by X and Y in formulas (1) and (2) includes a cycloalkylene group having 5 to 12 carbon atoms and a cycloalkylenedialkylene group.

Examples of a substituent for the alkyl group and aryl group include an alkoxyl group having 1 to 12 carbon atoms, preferably 1 to 6 carbon atoms, acyl group, acyloxy group, and a halogen atom such as a chlorine atom, bromine atom, iodine atom, or fluorine atom.

To be more specific, polymers and copolymers comprising the following structural units are preferably used as the binder resins for the charge transport layer:

(4)

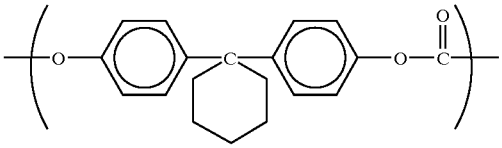

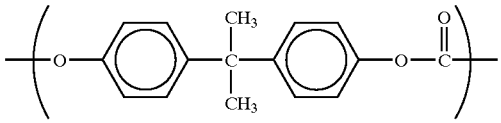

(5)

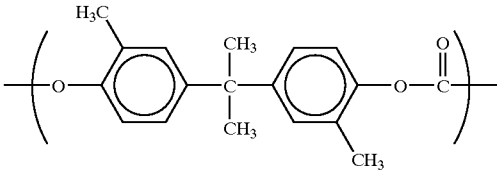

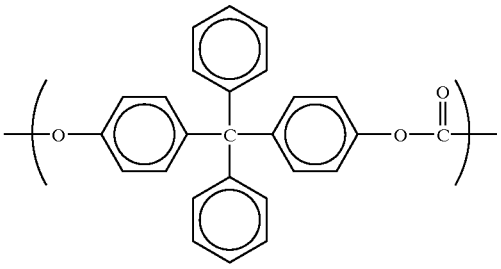

(6)

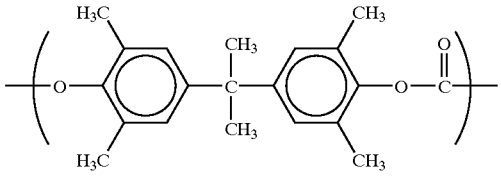

-continued
(7)
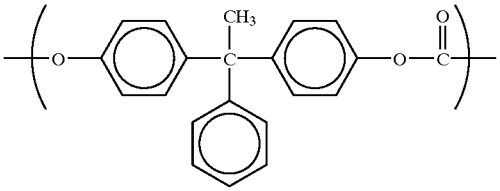
(8)
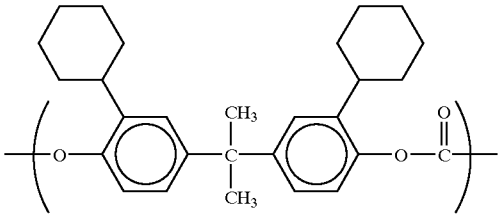
(9)
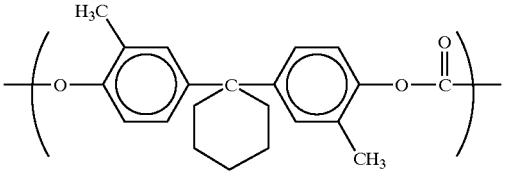
(10)
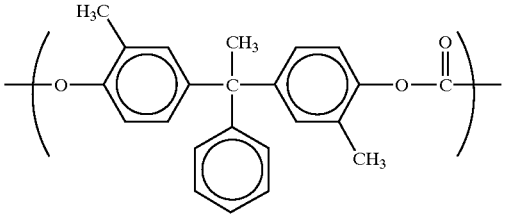
(11)
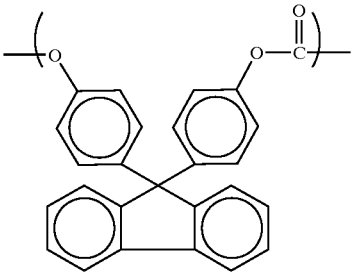
(12)
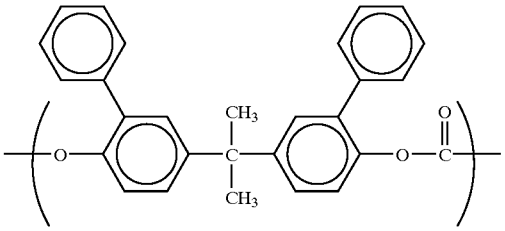
(13)
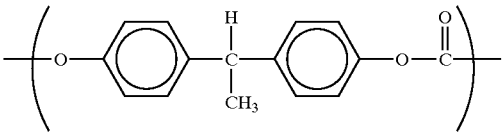
(14)
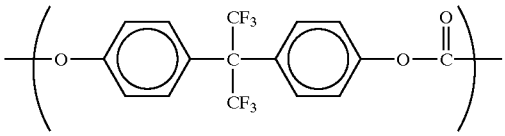
(15)
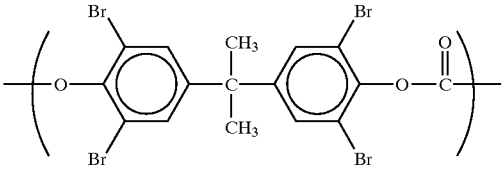
(16)
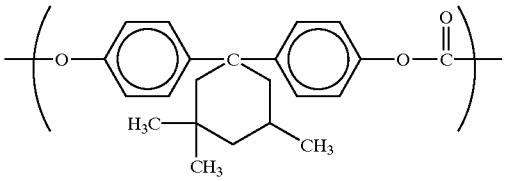
(17)
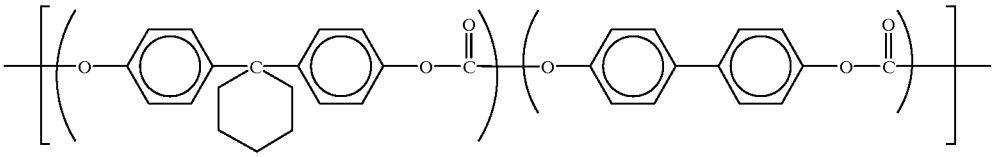
(18)
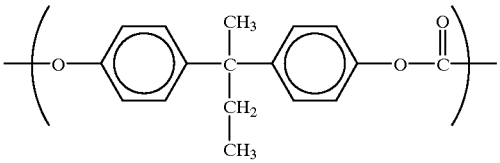

-continued (19)

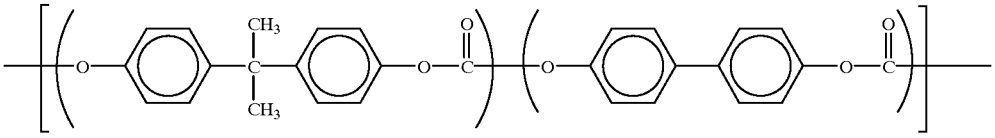

(20)

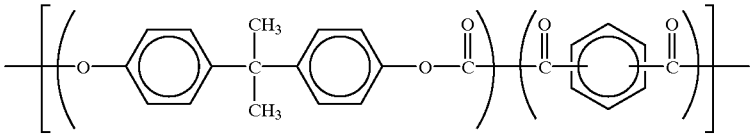

(21)

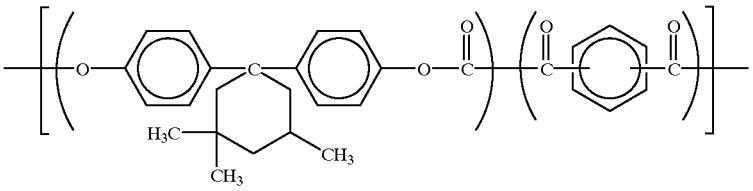

(22)

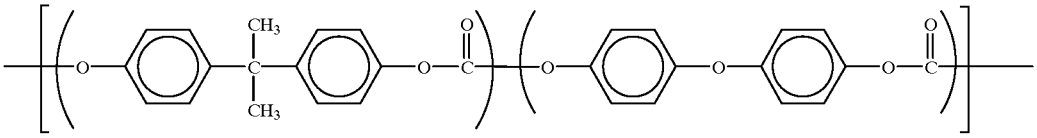

(23)

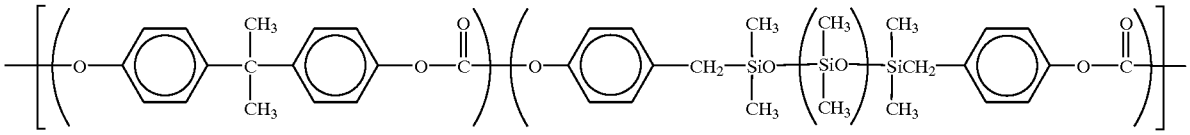

The charge transport material for use in the charge transport layer is roughly divided into a low-molecular weight charge transport material and a high-molecular weight charge transport material.

Examples of the high-molecular weight charge transport material include poly-N-carbazole and derivatives thereof, poly-γ-carbazolylethyl glutamate and derivatives thereof, polyvinyl pyrene, and polyvinyl phenanthrene.

Examples of the low-molecular weight charge transport material (CTM) include pyrene-formaldehyde condensation product and derivatives thereof, oxazole derivatives, imidazole derivatives, triphenylamine derivatives, and the following compounds represented by formulas (24) to (29) and (33) to (35):

[Low-molecular weight CTM of formula (24)]

(24)

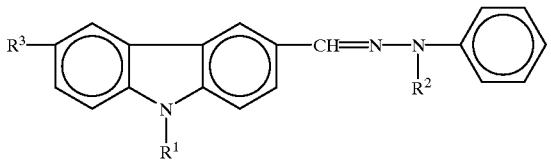

wherein $R^1$ is methyl group, ethyl group, 2-hydroxyethyl group, or 2-chloroethyl group; $R^2$ is methyl group, ethyl group, benzyl group, or phenyl group; and $R^3$ is a hydrogen atom, a chlorine atom, a bromine atom, an alkyl group having 1 to 4 carbon atoms, an alkoxyl group having 1 to 4 carbon atoms, a dialkylamino group, or nitro group.

Examples of the above compound of formula (24) are 9-ethylcarbazole-3-aldehyde-1-methyl-1-phenylhydrazone, 9-ethylcarbazole-3-aldehyde-1-benzyl-1-phenylhydrazone, and 9-ethylcarbazole-3-aldehyde-1,1-diphenylhydrazone.

[Low-molecular weight CTM of formula (25)]

(25)

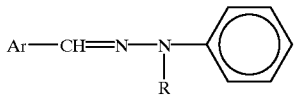

wherein Ar is naphthalene ring, anthracene ring, pyrene ring, each of which may have a substituent, pyridine ring, furan ring, or thiophene ring; and R is an alkyl group, phenyl group, or benzyl group.

Examples of the above compound of formula (25) are 4-diethylaminostyryl-β-aldehyde-1-methyl-1-phenylhydrazone, and 4-methoxynaphthalene-1-aldehyde-1-benzyl-1-phenylhydrazone.

[Low-molecular weight CTM of formula (26)]

(26)

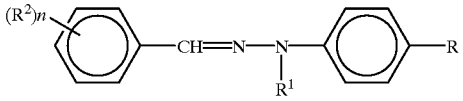

wherein $R^1$ is an alkyl group, benzyl group, phenyl group, or naphthyl group; $R^2$ is a hydrogen atom, an alkyl group having 1 to 3 carbon atoms, an alkoxyl group having 1 to 3 carbon atoms, a dialkylamino group, a diaralkylamino group, or a diarylamino group; n is an integer of 1 to 4, and when n is 2 or more, $R^2$ may be the same or different; and $R^3$ is a hydrogen atom or methoxy group.

Examples of the above compound of formula (26) are 4-methoxybenzaldehyde-1-methyl-1-phenylhydrazone, 2,4-dimethoxybenzaldehyde-1-benzyl-1-phenylhydrazone, 4-diethylaminobenzaldehyde-1,1-diphenylhydrazone, 4-methoxybenzaldehyde-1-(4-methoxy)phenylhydrazone, 4-diphenylaminobenzaldehyde-1-benzyl-1-phenylhydrazone, and 4-dibenzylaminobenzaldehyde-1,1-diphenylhydrazone.

[Low-molecular weight CTM of formula (27)]

(27)

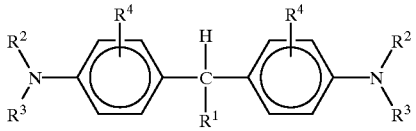

wherein $R^1$ is an alkyl group having 1 to 11 carbon atoms, a substituted or unsubstituted phenyl group, or a heterocyclic group; $R^2$ and $R^3$, which may be the same or different, are each a hydrogen atom, an alkyl group having 1 to 4 carbon atoms, a hydroxyalkyl group, chloroalkyl group, or a substituted or unsubstituted aralkyl group, and $R^2$ and $R^3$ may form a nitrogen-containing heterocyclic ring in combination; and $R^4$, which may be the same or different, each is a hydrogen atom, an alkyl group having 1 to 4 carbon atoms, an alkoxyl group, or a halogen atom.

Examples of the above compound of formula (27) are 1,1-bis(4-dibenzylaminophenyl)propane, tris(4-diethylaminophenyl)methane, 1,1-bis(4-dibenzylaminophenyl)propane, and 2,2'-dimethyl-4,4'-bis(diethylamino)triphenylmethane.

[Low-molecular weight CTM of formula (28)]

(28)

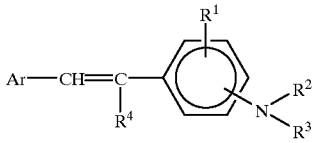

wherein $R^1$ is a hydrogen atom, an alkyl group, an alkoxyl group, or a halogen atom; $R^2$ and $R^3$ are each an alkyl group, a substituted or unsubstituted aralkyl group, or a substituted or unsubstituted aryl group; $R^4$ is a hydrogen atom, a lower alkyl group, or a substituted or unsubstituted phenyl group; and Ar is a substituted or unsubstituted phenyl group, or naphthyl group.

Examples of the above compound of formula (28) are 4-diphenylaminostilbene, 4-dibenzylaminostilbene, 4-ditolylaminostilbene, 1-(4-diphenylaminostyryl)naphthalene, and 1-(4-diethylaminostyryl)naphthalene,

[Low-molecular weight CTM of formula (29)]

(29)

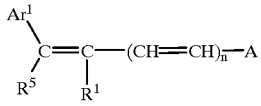

wherein n is an integer of 0 or 1, and when n=0, A and $R^1$ may form a ring in combination; $R^1$ is a hydrogen atom, an alkyl group, or a substituted or unsubstituted phenyl group; $Ar^1$ is a substituted or unsubstituted aryl group; $R^5$ is a substituted or unsubstituted alkyl group, or a substituted or unsubstituted aryl group; and A is 9-anthryl group, a substituted or unsubstituted carbazolyl group, (30)

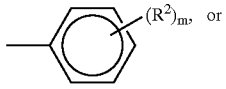

(31)

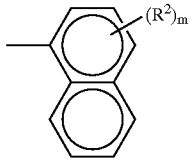

in which m is an integer of 0 to 3, and when m is 2 or 3, $R^2$ may be the same or different; and $R^2$ is a hydrogen atom, an alkyl group, an alkoxyl group, a halogen atom, or (32)

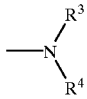

in which $R^3$ and $R^4$ may be the same or different and are each an alkyl group, a substituted or unsubstituted aralkyl group, or a substituted or unsubstituted aryl group, and $R^3$ and $R^4$ may form a ring in combination.

Examples of the above compound of formula (29) are 4'-diphenylamino-α-phenylstilbene and 4'-bis(4-methylphenyl) amino-α-phenylstilbene.

[Low-molecular weight CTM of formula (33)]

(33)

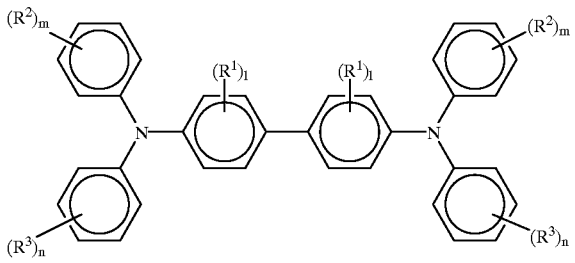

wherein $R^1$ is a lower alkyl group, a lower alkoxyl group, or a halogen atom; $R^2$ and $R^3$, which may be the same or different, are each a hydrogen atom, a lower alkyl group, a lower alkoxyl group, or a halogen atom; and l, m, and n are each an integer of 0 to 4.

Examples of the benzidine compound of formula (33) are N,N'-diphenyl-N,N'-bis(3-methylphenyl)-[1,1'-biphenyl]-4,4'-diamine and 3,3'-dimethyl-N,N,N',N'-tetrakis(3,4-dimethylphenyl)-[1,1'-biphenyl]-4,4'-diamine.

[Low-molecular weight CTM of formula (34)]

(34)

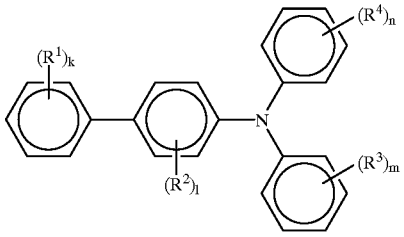

wherein $R^1$, $R^3$, $R^4$ are each a hydrogen atom, amino group, an alkoxyl group, a thioalkoxyl group, an aryloxy group, methylenedioxy group, a substituted or unsubstituted alkyl group, a halogen atom, or a substituted or unsubstituted aryl group; $R^2$ is a hydrogen atom, an alkoxyl group, a substituted or unsubstituted alkyl group, or a halogen atom, provided $R^1$, $R^2$, $R^3$ and $R^4$ are not hydrogen atoms at the same time; and k, l, m, and n are each an integer of 1 to 4, and when each is an integer of 2, 3 or 4, a plurality of groups represented by $R^1$, $R^2$, $R^3$, or $R^4$ may be the same or different.

Examples of the biphenylylamine compound of formula (34) are 4'-methoxy-N,N-diphenyl-[1,1'-biphenyl]-4-amine, 4'-methyl-N,N-bis(4-methylphenyl)-[1,1'-biphenyl]-4-amine, 4'-methoxy-N,N-bis(4-methylphenyl)-[1,1'-biphenyl]-4-amine, and N,N-bis(3,4-dimethylphenyl)-[1,1'-biphenyl]-4-amine.

[Low-molecular weight CTM of formula (35)]

(35)

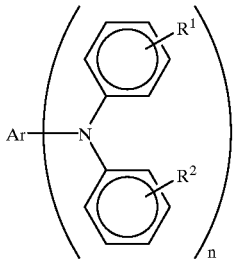

wherein Ar is a condensed polycyclic hydrocarbon group having 18 or less carbon atoms, which group may have a substituent; $R^1$ and $R^2$, which may be the same or different, are each a hydrogen atom, a halogen atom, a substituted or unsubstituted alkyl group, an alkoxyl group, or a substituted or unsubstituted phenyl group; and n is an integer of 1 or 2.

Examples of the triarylamine compound of formula (35) are N-di(p-tolyl)-1-naphthylamine, N,N-di(p-tolyl)-1-phenanthrylamine, 9,9-dimethyl-2-(di-p-tolylamino) fluorene, N,N,N',N'-tetrakis(4-methylphenyl)phenanthrene-9,10-diamine, and N,N,N',N'-tetrakis (3-methylphenyl)-m-phenylenedianine.

The following compounds of formulas (36) to (46), and a mixture of those compounds are given as examples of the high-molecular weight charge transport materials for use in the present invention.

(36)

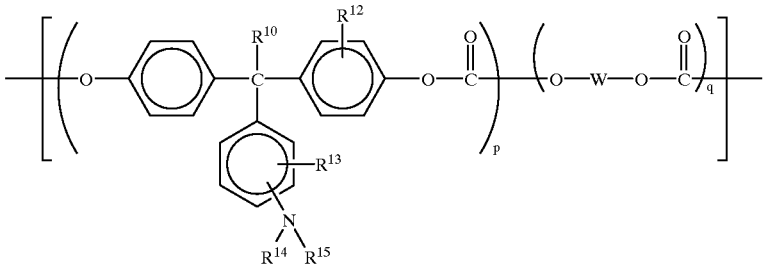

(37)

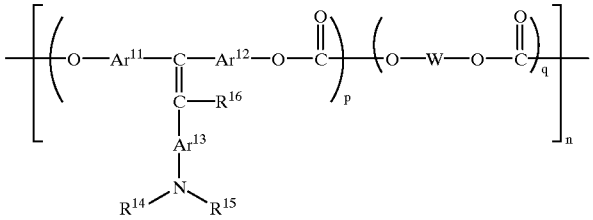

-continued
(38)
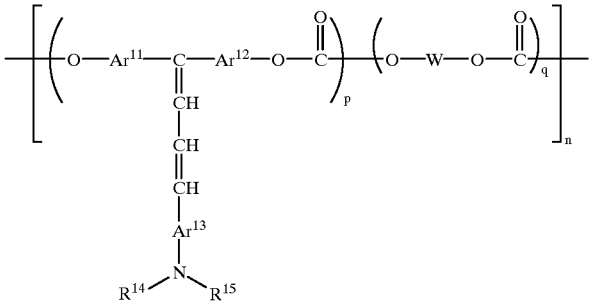
(39)
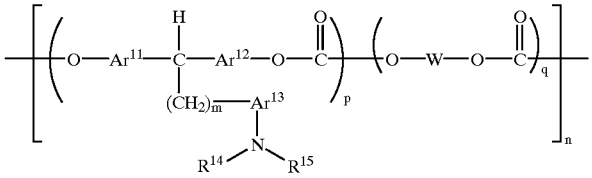
(40)
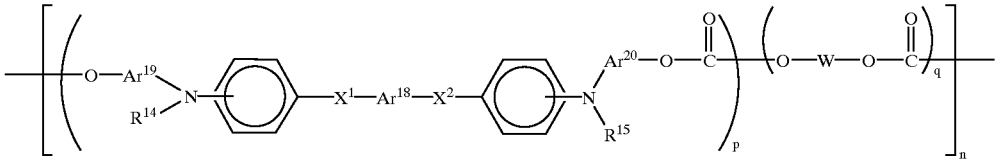
(41)
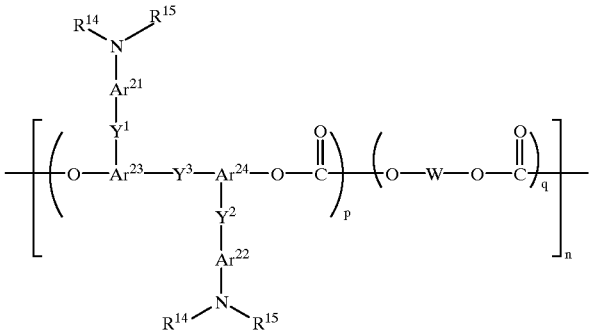
(42)
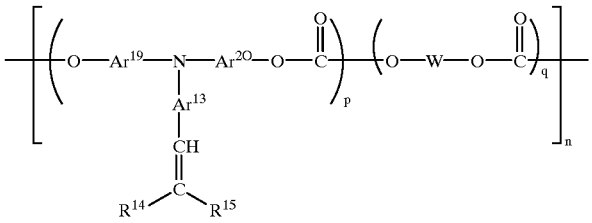
(43)
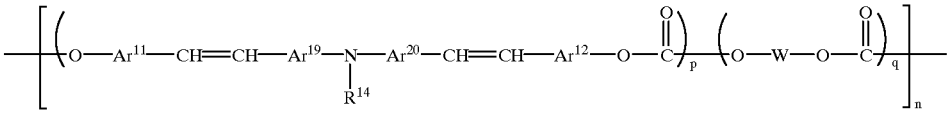

-continued (44)

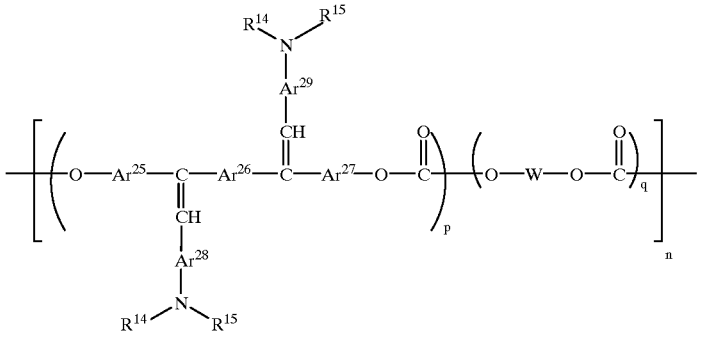

(45)

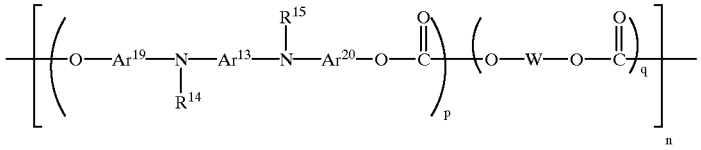

(46)

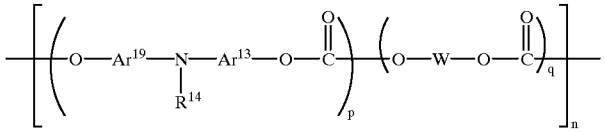

wherein $R^{11}$, $R^{12}$, and $R^{13}$ are each a hydrogen atom, a substituted or unsubstituted alkyl group, or a halogen atom; $R^{10}$ is a hydrogen atom, or a substituted or unsubstituted alkyl group; $R^{14}$ and $R^{15}$ are each a substituted or unsubstituted aryl group; $R^{16}$ is a hydrogen atom, a substituted or unsubstituted alkyl group, or a substituted or unsubstituted aryl group; $Ar^{11}$, $Ar^{12}$, $Ar^{13}$, $Ar^{18}$, $Ar^{19}$, $Ar^{20}$, $Ar^{21}$, $Ar^{22}$, $Ar^{23}$, $Ar^{24}$, $Ar^{25}$, $Ar^{26}$, $Ar^{27}$, $Ar^{28}$, and $Ar^{29}$ are each an arylene group; p and q represent composition ratios, and $0.1 \leqq p \leqq 1$ and $0 \leqq q \leqq 0.9$; and n represents the number of repeat units, and is an integer of 5 to 5,000; and W is a bivalent aliphatic group, a bivalent alicyclic group, or a bivalent group represented by the following formula (47):

(47)

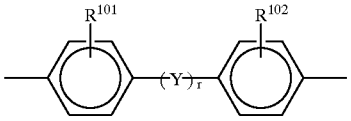

in which $R^{101}$ and $R^{102}$ are each a substituted or unsubstituted alkyl group, an aryl group, or a halogen atom; r is 0 or 1; and when r is 1, Y is a straight-chain, branched, or cyclic alkylene group having 1 to 12 carbon atoms, —O—, —S—, —SO—, —$SO_2$—, —CO—, or —CO—O—Z—O—CO— (where Z is a bivalent aliphatic group.)

More specifically, high-molecular weight charge transport materials comprising repeat units represented by the following formulas (48) to (71) can be used in the present invention. Those materials may be in the form of a homopolymer, random copolymer, alternating copolymer, or block copolymer.

(48)

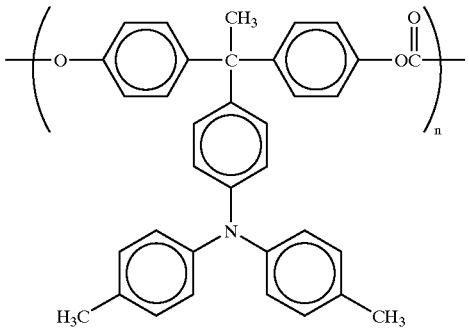

(49)

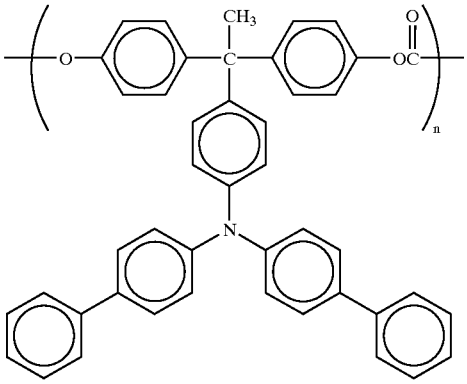

-continued
(50)
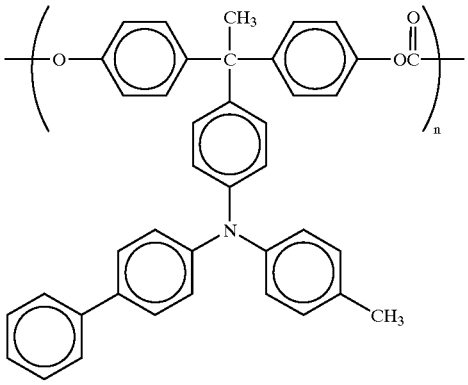
(51)
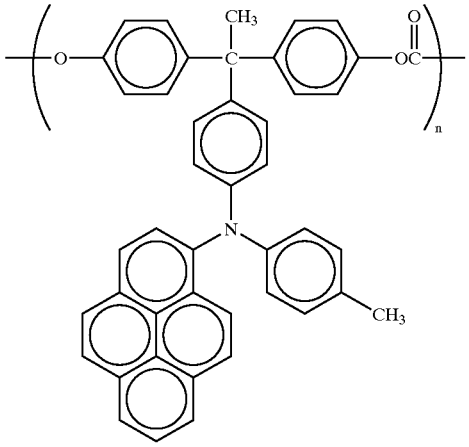
(52)
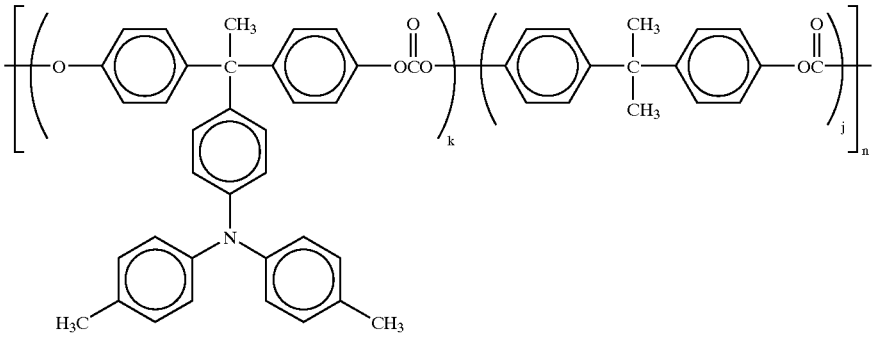
(53)
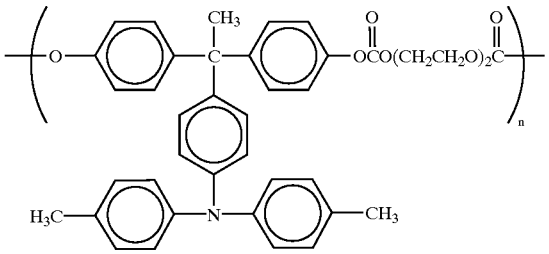
(54)
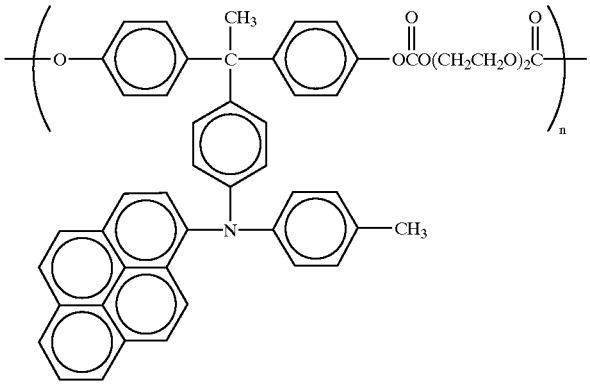
(55)
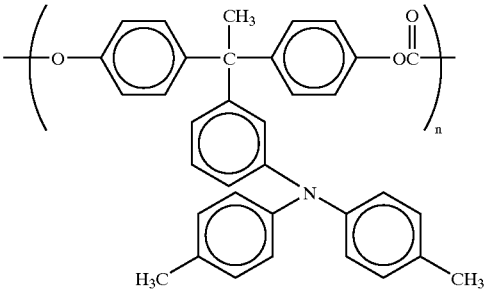

-continued
(56)
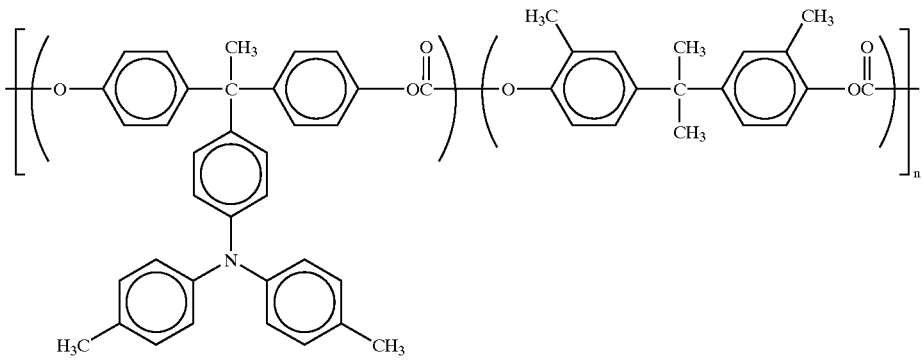
(57)
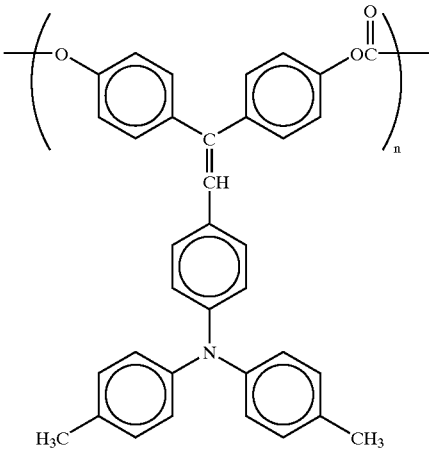
(58)
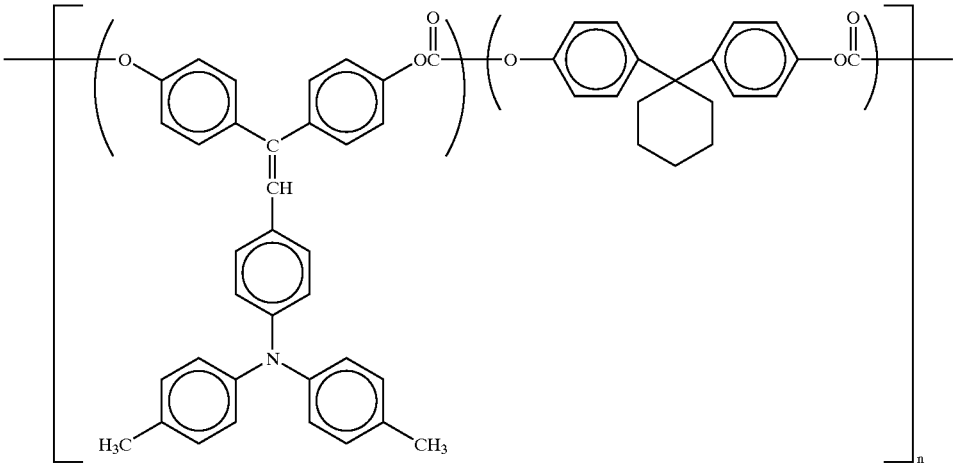

-continued
(59)
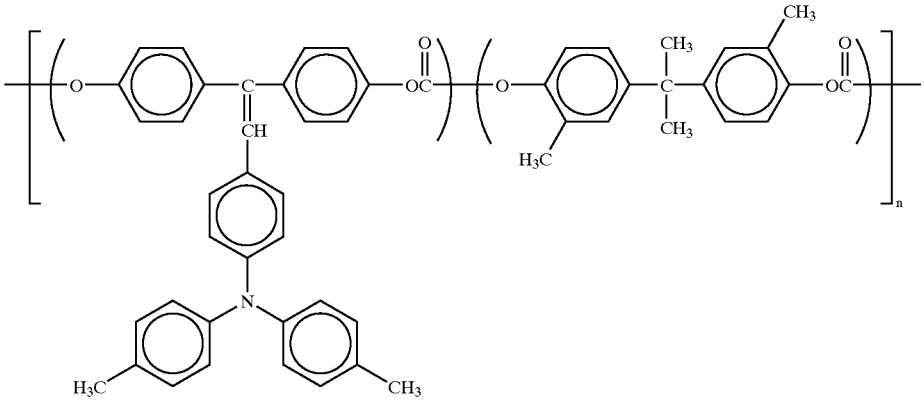
(60)
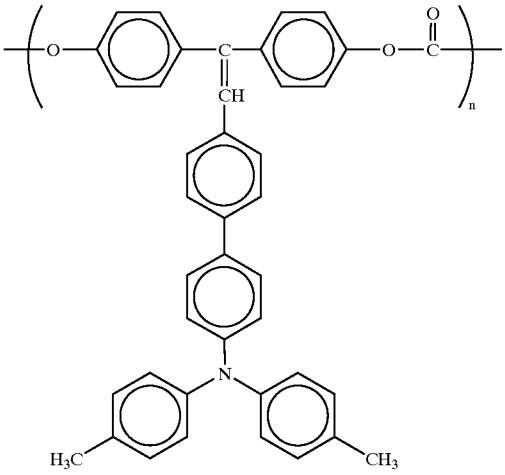
(61)
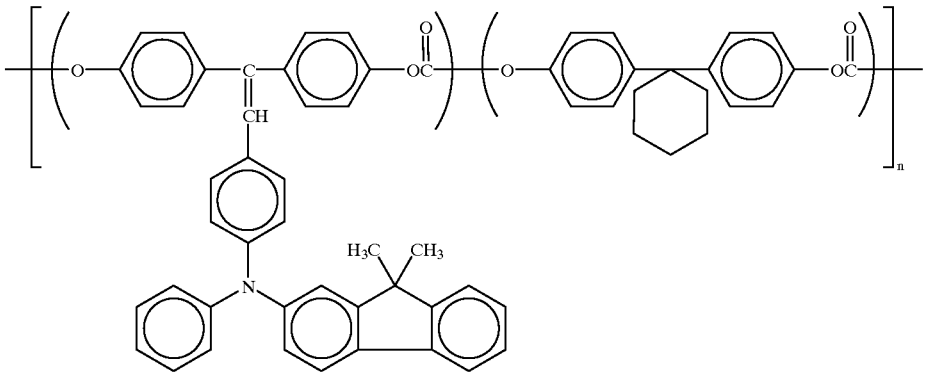

-continued
(62)
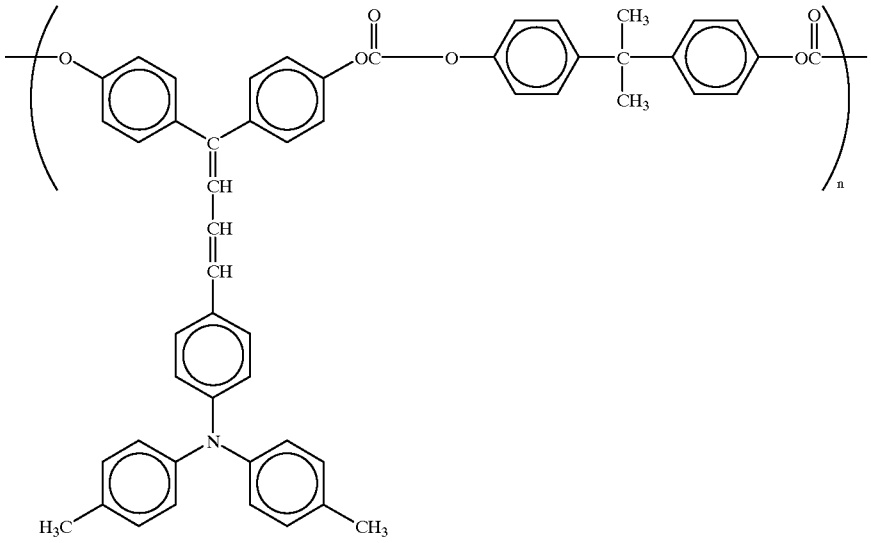
(63)
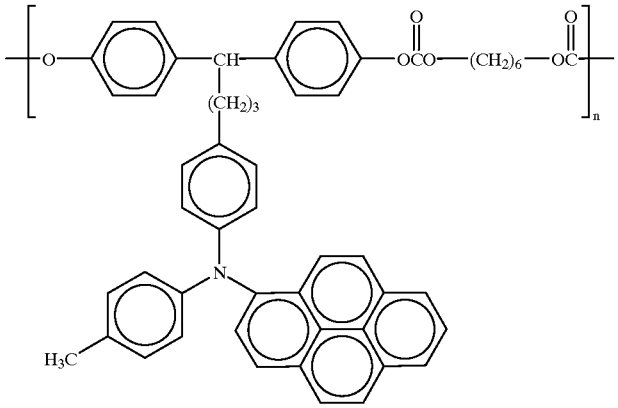
(64)
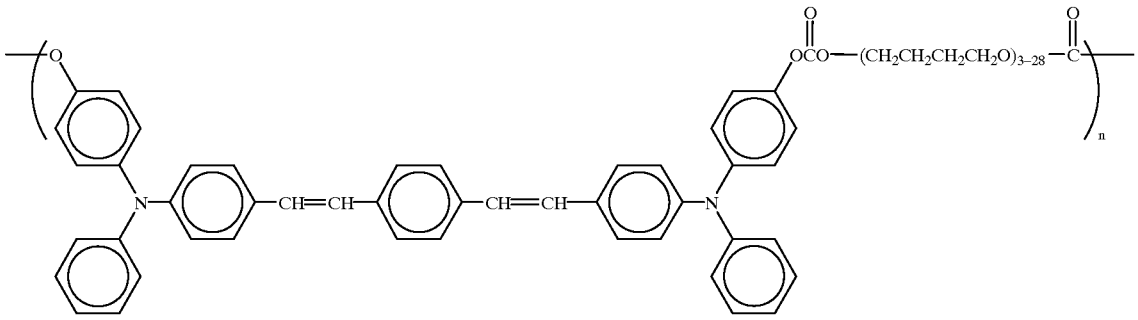

-continued
(65)
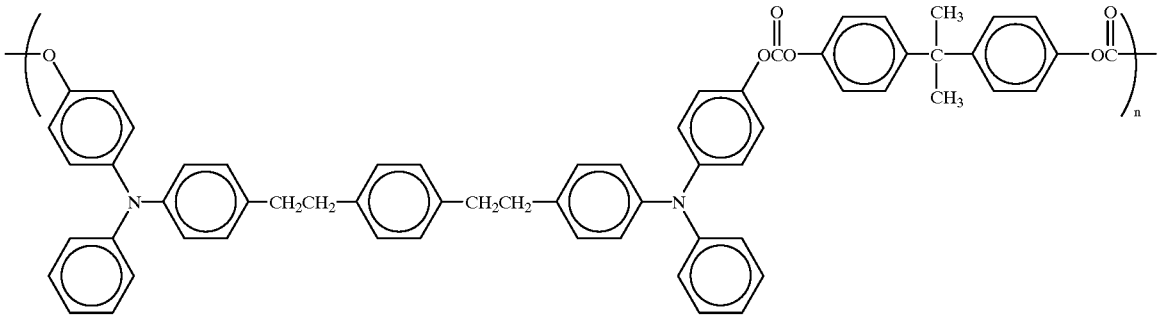
(66)
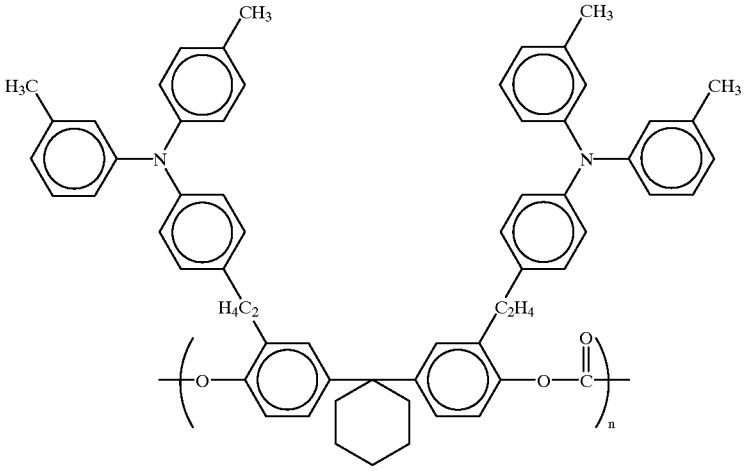
(67)
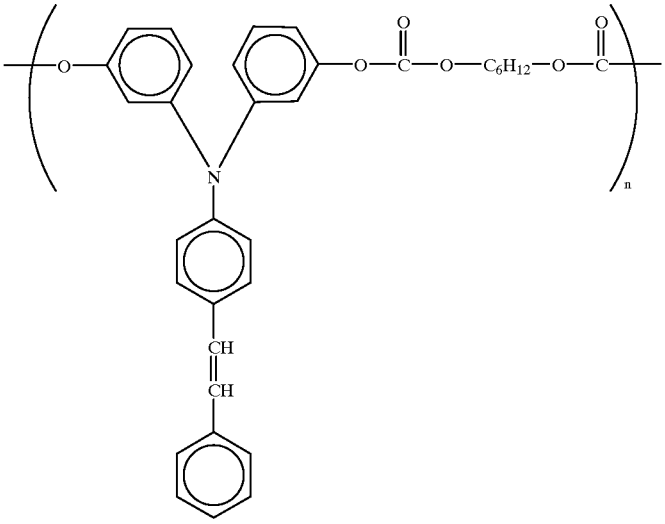

-continued
(68)
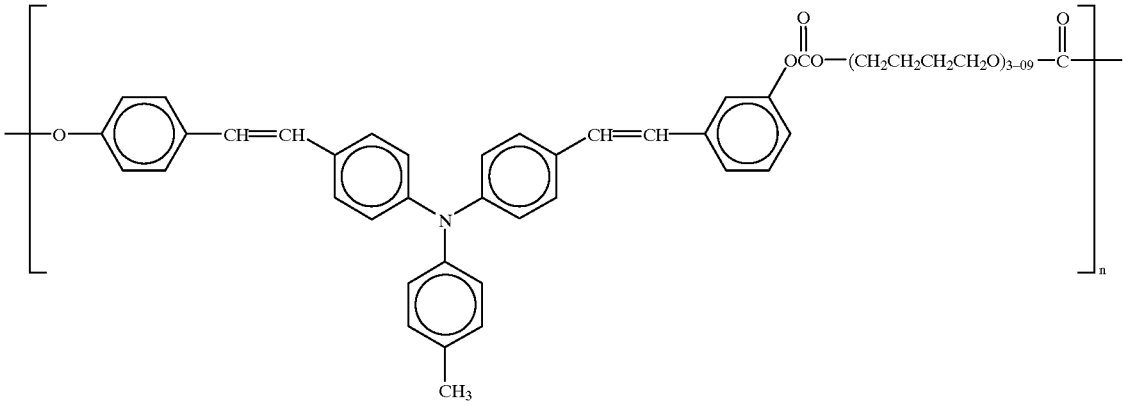
(69)
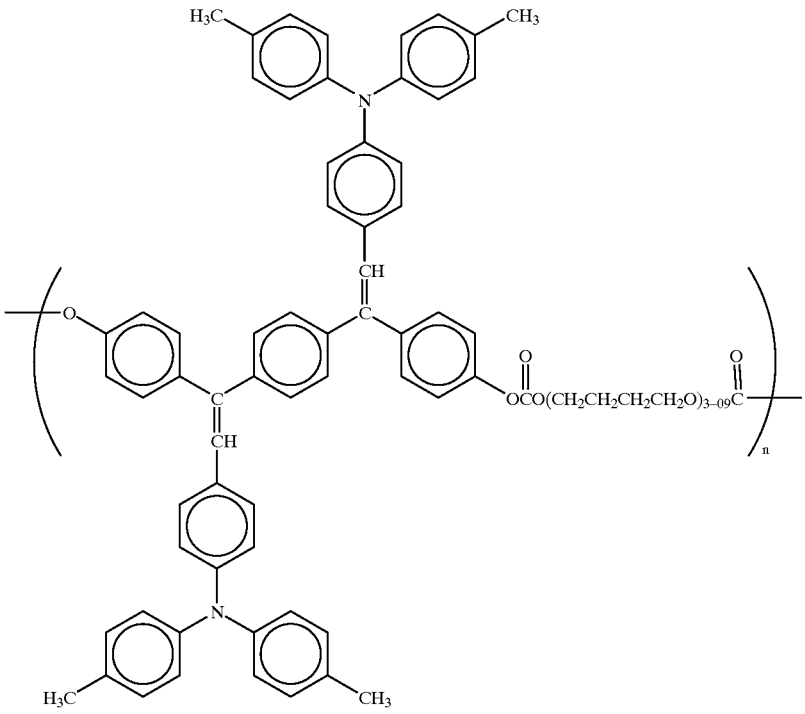
(70)
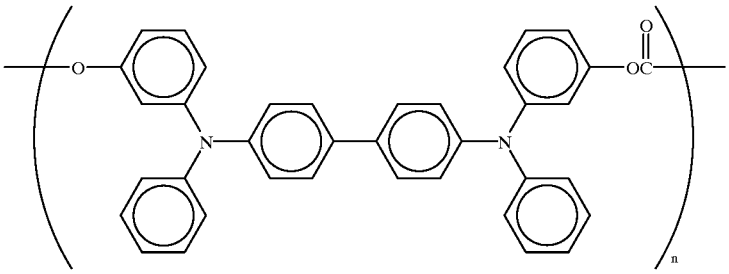

-continued (71)

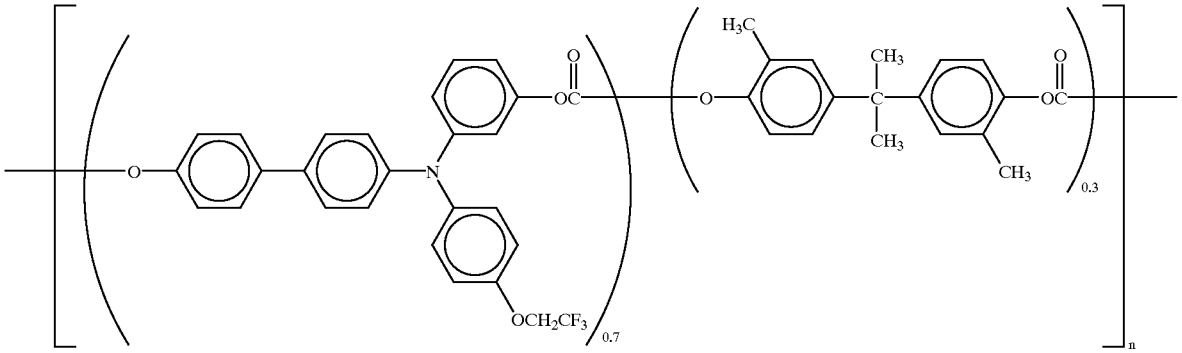

The above-mentioned low-molecular weight charge transport materials and high-molecular weight charge transport materials may be used in combination in the charge transport layer.

Examples of the filler for use in the present invention are titanium oxide, tin oxide, zinc oxide, zirconium oxide, indium oxide, silicon nitride, calcium oxide, barium sulfate, indium-tin oxide (ITO), silica, colloidal silica, alumina, carbon black, finely-divided particles of a fluorine-containing resin, finely-divided particles of a polysiloxane resin, and finely-divided particles of a high-molecular weight charge transport material. These fillers may be used alone or in combination.

The filler may be surface-treated with an inorganic or organic material in order to improve the dispersion properties and to modify the surface properties. For hydrophobic surface treatment, the filler is usually treated with a silane coupling agent, fluorine-containing silane coupling agent, or a higher fatty acid. Or the filler may be formed into a copolymer together with a polymeric material. When the surface of the filler may be treated with an inorganic material, alumina, zirconia, tin oxide, or silica can be used.

The filler is pulverized when necessary, and dispersed together with the above-mentioned low-molecular weight charge transport material, high-molecular weight material, binder resin, and dispersion medium, thereby preparing a coating liquid for charge transport layer, When the charge transport layer comprises a filler, it is preferable that the amount ratio by weight of filler be in the range of 5 to 50 wt. %, and more preferably 10 to 40 wt. %, of the total weight of the charge transport layer. When the filler is contained in an amount of 5 to 50 wt. % of the total weight of the charge transport layer, the wear resistance of the layer can sufficiently improve, without impairing transparency of the charge transport layer as a whole. This will prevent the decrease of sensitivity.

The mean particle diameter of the filler may be in the range of 0.05 to 1.0 $\mu$m, preferably in the range of 0.05 to 0.8 $\mu$m. When the filler has the mean particle diameter within the above-mentioned range, the surface roughness of the charge transport layer is acceptable for practical use, and there is no possibility that protruding filler particles will damage a cleaning blade disposed in contact with the surface of the photoconductor. Defective cleaning performance can be thus prevented, thereby maintaining high image quality.

When the coating liquid comprises finely-divided particles of a filler, the following dispersion medium is preferably employed: ketones such as methyl ethyl ketone, acetone, methyl isobutyl ketone, and cyclohexanone; ethers such as dioxane, tetrahydrofuran, and ethyl cellosolve; aromatic solvents such as toluene and xylene; halogenated solvents such as chlorobenzene and dichloromethane; and esters such as ethyl acetate and butyl acetate. When the preparation of a coating liquid needs a pulverizing step, a ball mill, sand mill, or oscillating mill is suitable.

It is preferable that 0.2 to 3 parts by weight, more preferably 0.4 to 1.5 parts by weight of the charge transport material be used in combination with one part by weight of the binder resin in the charge transport layer. The high-molecular weight charge transport material can constitute the charge transport layer without any binder resin. When the low-molecular weight charge transport material is used for the charge transport layer, the high-molecular weight charge transport material may be used as the binder resin.

The charge transport layer can be provided by coating methods such as dip coating, spray coating, ring coating, roll coating, gravure coating, or nozzle coating.

It is preferable that the thickness of the charge transport layer 3 in FIG. 2 or the first charge transport layer 4 in FIG. 3 or FIG. 4 be in the range of about 5 to about 30 $\mu$m. The second charge transport layers 5 and 6 respectively shown in FIG. 3 and FIG. 4 may have a thickness of 0.5 to 10 $\mu$m, preferably 0.5 to 5 $\mu$m.

The photoconductive layer for use in the present invention may further comprise a plasticizer and a leveling agent.

Any plasticizers that are contained in the general-purpose resins, such as dibutyl phthalate and dioctyl phthalate can be used as it is. It is proper that the amount of plasticizer be in the range of 0 to about 30 wt. % of the total weight of the binder resin.

As the leveling agent, there can be employed silicone oils such as dimethyl silicone oil and methylphenyl silicone oil, and polymers and oligomers having a perfluoroalkyl group on the side chain thereof. The proper amount of leveling agent is at most about 1 wt. % of the total weight of the binder resin.

To prepare the electroconductive support 1 for use in the electrophotographic photoconductor, a plate, drum, or foil made of a metal such as aluminum, nickel, copper, titanium, gold, or stainless steel can be used. Alternatively, a plastic film coated with aluminum, nickel, copper, titanium, gold, tin oxide, or indium oxide by deposition, or a sheet of paper coated with an electroconductive material, which may be in a cylindrical form, is used as the electroconductive support.

The undercoat layer (not shown in the figures), which is provided on the electroconductive support 1, comprises a resin as the main component. Since the photoconductive layer is provided on the undercoat layer by coating method using a solvent, it is desirable that the resin for use in the undercoat layer have high resistance against general-purpose organic solvents.

Preferable examples of the resin for use in the undercoat layer include water-soluble resins such as poly(vinyl alcohol), casein, and sodium polyacrylate; alcohol-soluble resins such as copolymer nylon and methoxymethylated nylon; and hardening resins with three-dimensional network such as polyurethane, melamine resin, phenolic resin, alkyd-melamine resin, and epoxy resin.

To effectively prevent the occurrence of Moiré and obtain an optimum resistivity, the undercoat layer may further comprise finely-divided particles of metallic oxides such as titanium oxide, silica, alumina, zirconium oxide, tin oxide, and indium oxide.

The undercoat layer can be provided on the electroconductive support by a coating method, using an appropriate solvent.

Further, a coupling agent such as silane coupling agent, titanium coupling agent, or chromium coupling agent can be used for the formation of the undercoat layer. Furthermore, to prepare the undercoat layer, $Al_2O_3$ may be deposited on the electroconductive support by the anodizing process, or an organic material such as polypara-xylylene (parylane), or inorganic materials such as SiO, $SnO_2$, $TiO_2$, ITO, and $CeO_2$ may be deposited on the electroconductive support by vacuum thin-film forming method.

It is preferable that the thickness of the undercoat layer be in the range of 0 to 5 $\mu$m.

To provide the charge generation layer 2, a charge generation material, with a binder resin being optionally added thereto, is dissolved or dispersed in a proper solvent to prepare a coating liquid for charge generation layer. The coating liquid thus prepared may be coated and dried.

The charge generation layer coating liquid is prepared through a dispersion process using a ball mill, ultrasonic mill, or homomixer. The coating liquid thus prepared can be coated by dip coating, blade coating, or spray coating.

When the charge generation layer is formed by dispersion coating of a charge generation material, it is preferable that the mean particle diameter of the charge generation material be 2 $\mu$m or less, and more preferably 1 $\mu$m or less, to promote the dispersion properties of the charge generation material in the obtained charge generation layer. However, when the mean particle diameter of the charge generation material is excessively small, the fine particles tend to aggregate, which will increase the resistivity of the obtained layer and increase defective crystals. As a result, the sensitivity and the repetition properties will deteriorate. In consideration of the limitation in pulverizing, the lower limit of the mean particle diameter of the charge generation material is preferably 0.01 $\mu$m.

It is preferable that the charge generation layer have a thickness of about 0.01 to about 5 $\mu$m and more preferably 0.1 to 2 $\mu$m.

Specific examples of the charge generation material for use in the present invention are as follows: organic pigments, for example, azo pigments, such as C.I. Pigment Blue 25 (C.I. 21180), C.I. Pigment Red 41 (C.I. 21200), C.I. Acid Red 52 (C.I. 45100), C.I. Basic Red 3 (C.I. 45210), an azo pigment having a carbazole skeleton (Japanese Laid-Open Patent Application 53-95033), an azo pigment having a distyryl benzene skeleton (Japanese Laid-Open Patent Application 53-133445), an azo pigment having a triphenylamine skeleton (Japanese Laid-Open Patent Application 53-132347), an azo pigment having a dibenzothiophene skeleton (Japanese Laid-Open Patent Application 54-21728), an azo pigment having an oxadiazole skeleton (Japanese Laid-Open Patent Application 54-12742), an azo pigment having a fluorenone skeleton (Japanese Laid-Open Patent Application 54-22834), an azo pigment having a bisstilbene skeleton (Japanese Laid-Open Patent Application 54-17733), an azo pigment having a distyryl oxadiazole skeleton (Japanese Laid-Open Patent Application 54-2129), an azo pigment having a distyryl carbazole skeleton (Japanese Laid-Open Patent Application 54-14967), and an azo pigment having a benzanthrone skeleton; phthalocyanine pigments such as C.I. Pigment Blue 16 (C.I. 74100), oxotitanium phthalocyanine, chloro-gallium phthalocyanine, and hydroxy-gallium phthalocyanine; indigo pigments such as C.I. Vat Brown 5 (C.I. 73410) and C.I. Vat Dye (C.I. 73030); and perylene pigments such as Algal Scarlet B and Indanthrene Scarlet R (made by Bayer Co., Ltd.). These charge generation materials may be used alone or in combination.

Examples of the solvent used to prepare a coating liquid for charge generation layer include N,N-dimethylformamide, toluene, xylene, monochlorobenzene, 1,2-dichloroethane, 1,1,1-trichloroethane, dichloromethane, 1,1,2-trichloroethane, trichloroethylene, tetrahydrofuran, methyl ethyl ketone, methyl isobutyl ketone, cyclohexanone, ethyl acetate, butyl acetate, and dioxane.

Any conventional binder resins having high electrical insulating properties are suitable as the binder resins for use in the charge generation layer.

Specific examples of such binder resins for use in the charge generation layer include addition polymerization resins, polyaddition resins, and polycondensation resins, such as polyethylene, poly(vinyl butyral), poly(vinyl formal), polystyrene resin, phenoxy resin, polypropylene, acrylic resin, methacrylic resin, vinyl chloride resin, vinyl acetate resin, epoxy resin, polyurethane resin, phenolic resin, polyester resin, alkyd resin, polycarbonate resin, polyamide resin, silicone resin, and melamine resin. Further, there can be employed copolymer resins comprising two or more repetition units of the above-mentioned resins, for example, electrical insulating resins such as vinyl chloride—vinyl acetate copolymer, styrene—acrylic copolymer, and vinyl chloride—vinyl acetate—maleic anhydride copolymer; and a high-molecular weight organic semiconductor such as poly-N-vinylcarbazole. These binder agents may be used alone or in combination.

It is preferable that the amount of the binder resin for use in the charge generation layer be in the range of 0 to 5 parts by weight, preferably 0.1 to 3 parts by weight, with respect to one part by weight of the charge generation material.

Furthermore, in the present invention, a phenol compound, a hydroquinone compound, a hindered phenol compound, a hindered amine compound, and a compound having both a hindered amine moiety and a hindered phenol moiety in a molecule may be preferably contained in the photoconductive layer for the improvement of charging characteristics.

The electrophotographic image forming apparatus and the process cartridge according to the present invention will now be explained in detail with reference to FIG. 5 to FIG. 7.

Figure 5:
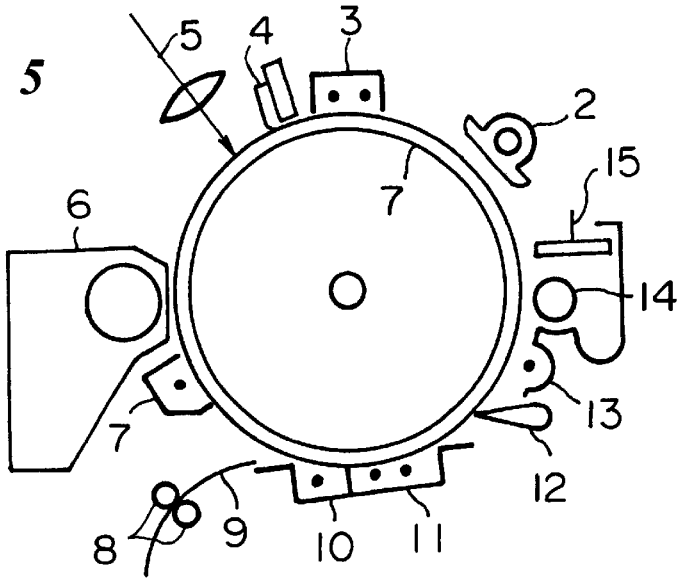
FIG. 5 is a schematic diagram in explanation of an embodiment of an electrophotographic image forming apparatus according to the present invention.

FIG. 5 is a schematic view which shows one embodiment of the electrophotographic image forming apparatus employing the electrophotographic photoconductor according to the present invention.

In FIG. 5, an electrophotographic photoconductor 1 according to the present invention, which is in the form of a drum, has such a structure that a charge generation layer and a charge transport layer are successively overlaid on an electroconductive support.

The photoconductor may be in the form of a drum as shown in FIG. 5, or a sheet or an endless belt.

As shown in FIG. 5, a charger 3, an eraser 4, a light exposure unit 5, a development unit 6, a pre-transfer charger 7, an image transfer charger 10, a separating charger 11, a separator 12, a pre-cleaning charger 13, a fur brush 14, a cleaning blade 15, and a quenching lamp 2 are disposed around the drum-shaped electrophotographic photoconductor 1.

The charger 3, the pre-transfer charger 7, the image transfer charger 10, the separating charger 11, and the pre-cleaning charger 13 may employ the conventional means such as a corotron charger, a scorotron charger, a solid state charger, and a charging roller.

For the image transfer means, it is effective to employ both the image transfer charger 10 and the separating charger 11 as illustrated in FIG. 5.

An LD or LED with wavelengths of 400 to 450 nm is used as a light source for the light exposure unit 5. As a light source for the quenching lamp 2, there can be employed, for example, a fluorescent tube, tungsten lamp, halogen lamp, mercury vapor lamp, sodium light source, light emitting diode (LED), semiconductor laser (LD), and electroluminescence (EL). Further, a desired wavelength can be selectively extracted by use of various filters such as a sharp-cut filter, bandpass filter, a near infrared cut filter, dichroic filter, interference filter, and color conversion filter.

The photoconductor may be irradiated with light in the course of the image transfer step, quenching step, cleaning step, or pre-light exposure step in addition to the steps as indicated by FIG. 5. In such a case, the above-mentioned light sources are usable.

The toner image formed on the photoconductor 1 using the development unit 6 is transferred to a transfer sheet 9 sent toward the photoconductor 1 through a pair of resist rollers 8. At the step of image transfer, all the toner particles deposited on the photoconductor 1 are not transferred to the transfer sheet 9. Some toner particles remain on the surface of the photoconductor 1. The remaining toner particles are removed from the photoconductor 1 using the fur brush 14 and the cleaning blade 15. The cleaning of the photoconductor may be carried out only by use of a cleaning brush. As the cleaning brush, there can be employed a conventional fur brush and magnetic fur brush.

When the photoconductor 1 is positively charged, and exposed to light images, positive electrostatic latent images are formed on the photoconductor 1. In a similar manner as above stated, when a negatively charged photoconductor is exposed to light images, negative electrostatic latent images are formed. A negative toner and a positive toner are respectively used for development of the positive electrostatic images and the negative electrostatic images, thereby forming positive images on the surface of the photoconductor 1. In contrast to this, when the positive electrostatic images and the negative electrostatic images are respectively developed using a positive toner and a negative toner, negative images can be obtained on the surface of the photoconductor 1. Not only such development means, but also the quenching means may employ the conventional manner.

Figure 6:
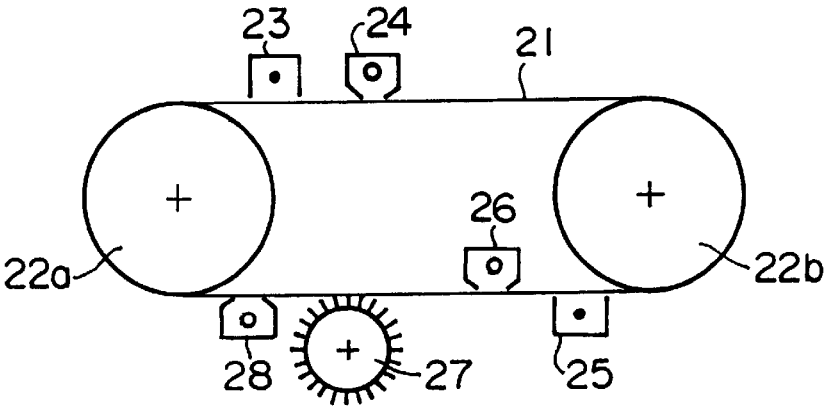
FIG. 6 is a schematic diagram in explanation of another embodiment of an electrophotographic image forming apparatus according to the present invention.

FIG. 6 is a schematic view which shows another embodiment of the electrophotographic image forming apparatus according to the present invention.

A photoconductor 21 shown in FIG. 6 according to the present invention, in the form of an endless belt, is driven by driving rollers 22*a* and 22*b*. Charging of the photoconductor 21 is carried out by use of a charger 23, and the charged photoconductor 21 is exposed to light images using a light source for image exposure 24. Thereafter, latent electrostatic images formed on the photoconductor 21 are developed to toner images using a development unit (not shown), and the toner images are transferred to a transfer sheet with the aid of a transfer charger 25. After the toner images are transferred to the transfer sheet, the photoconductor 21 is subjected to pre-cleaning light exposure using a pre-cleaning light 26, and physically cleaned by use of a cleaning brush 27. Finally, quenching is carried out using a quenching lamp 28. In FIG. 6, the electroconductive support of the photoconductor 21 has light transmission properties, so that it is possible to apply the pre-cleaning light 26 to the electroconductive support side of the photoconductor 21.

As a matter of course, the photoconductive layer side of the photoconductor 21 may be exposed to the pre-cleaning light. Similarly, the light source for image exposure 24 and the quenching lamp 28 may be disposed so that light is directed toward the electroconductive support side of the photoconductor 21.

The photoconductor 21 is irradiated with light using the light source for image exposure 24, the pre-cleaning light 26, and the quenching lamp 28, as illustrated in FIG. 6. In addition to the above, light exposure may be carried out before image transfer, and before image exposure.

The above-discussed units, such as the charging unit, light exposure unit, development unit, image transfer unit, cleaning unit, and quenching unit may be fixedly incorporated in the electrophotographic image forming apparatus such as copying machines, facsimile machines, and printers. Alternatively, at least one of those units may be set in a process cartridge together with the photoconductor. To be more specific, the process cartridge may hold therein a photoconductor, and at least one of the charging means, light exposure means, development means, image transfer means, cleaning means, or quenching means. The process cartridge may by detachably set in the above-mentioned electrophotographic image forming apparatus.

Figure 7:
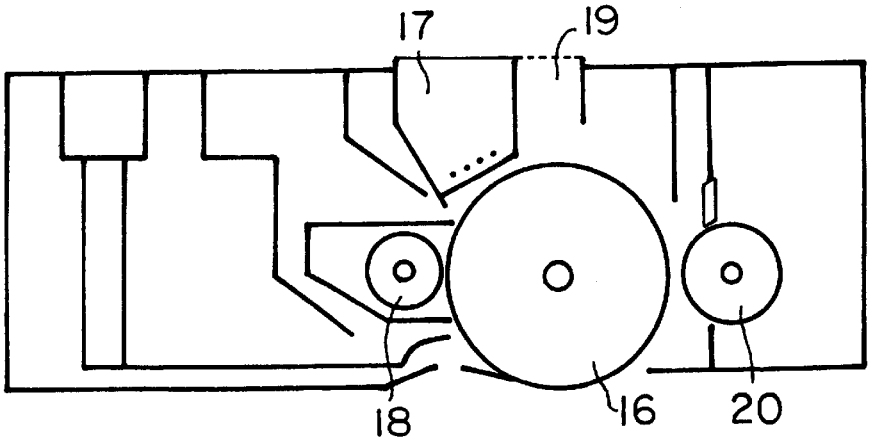
FIG. 7 is a schematic diagram in explanation of an example of a process cartridge according to the present invention.
Figure 8:
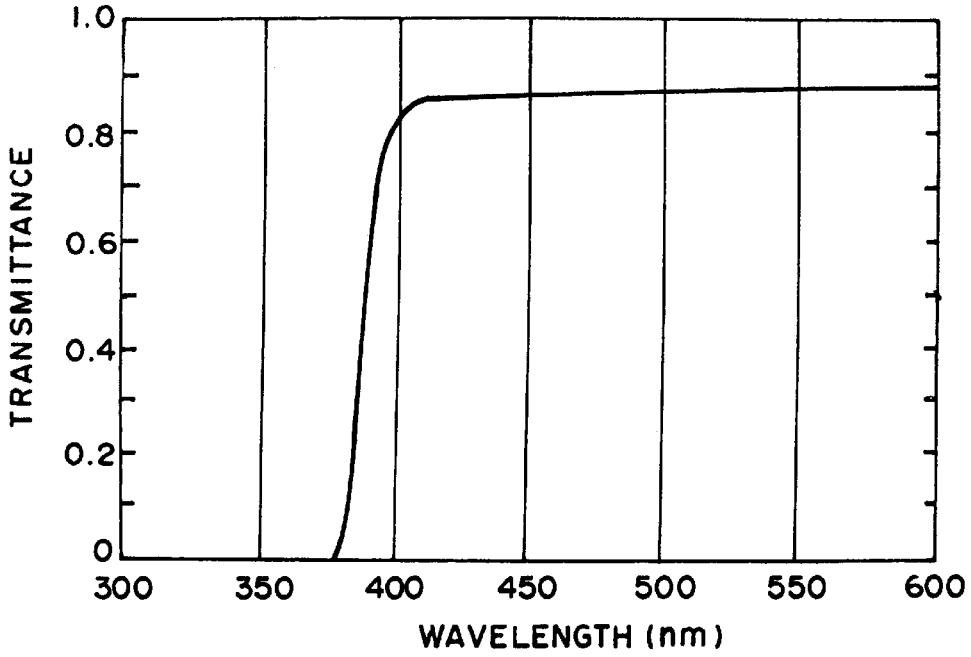
FIG. 8 is a transmission spectrum of a charge transport layer film for use in a photoconductor No. 1 fabricated in Example I-1.
Figure 9:
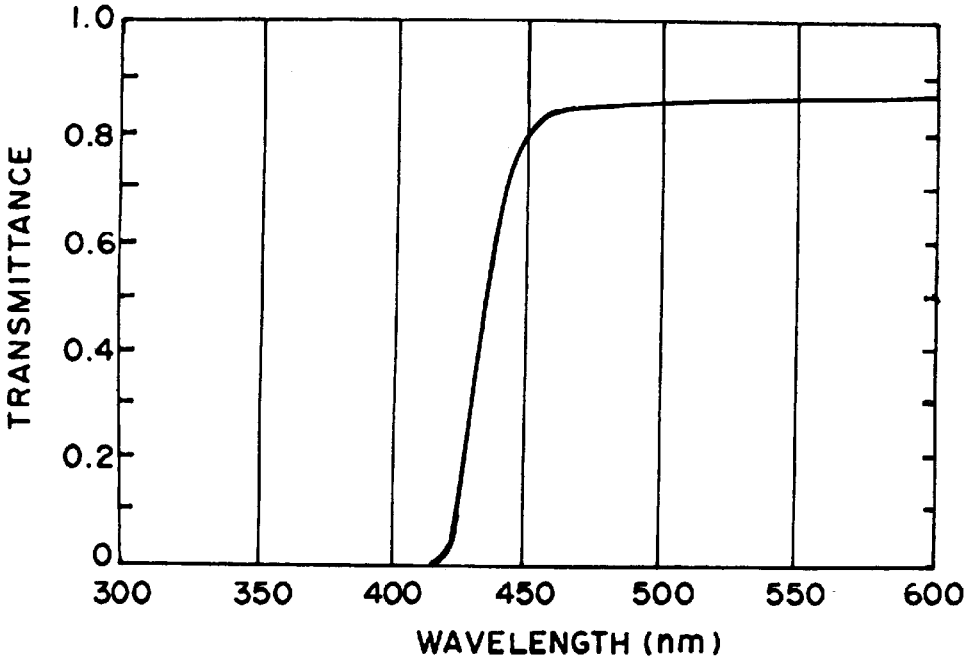
FIG. 9 is a transmission spectrum of a charge transport layer film for use in a photoconductor No. 2 fabricated in Example I-2.
Figure 10:
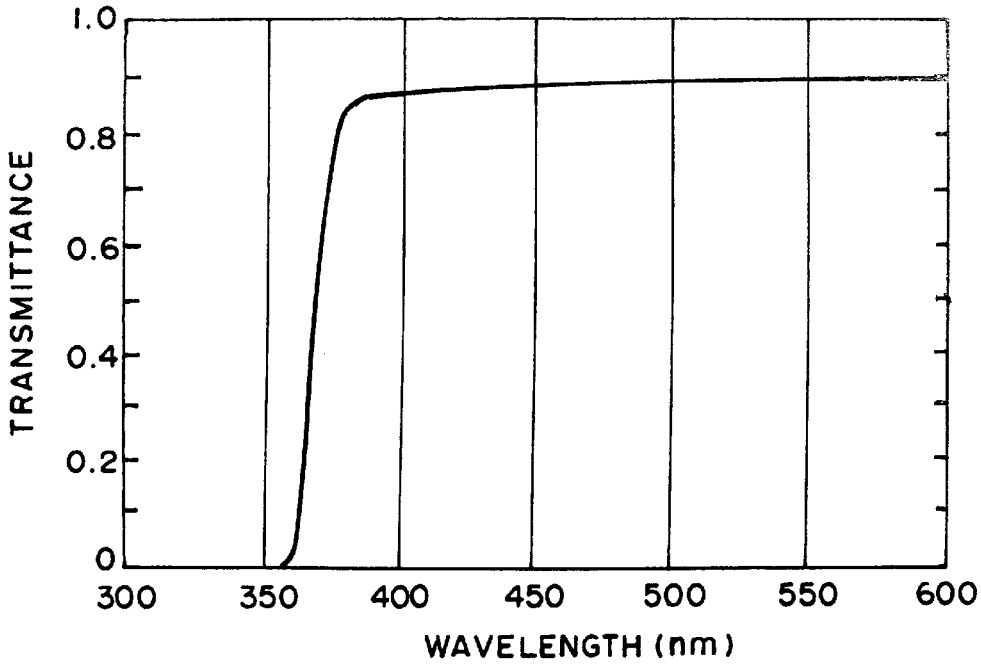
FIG. 10 is a transmission spectrum of a charge transport layer film for use in a photoconductor No. 3 fabricated in Example I-3.
Figure 11:
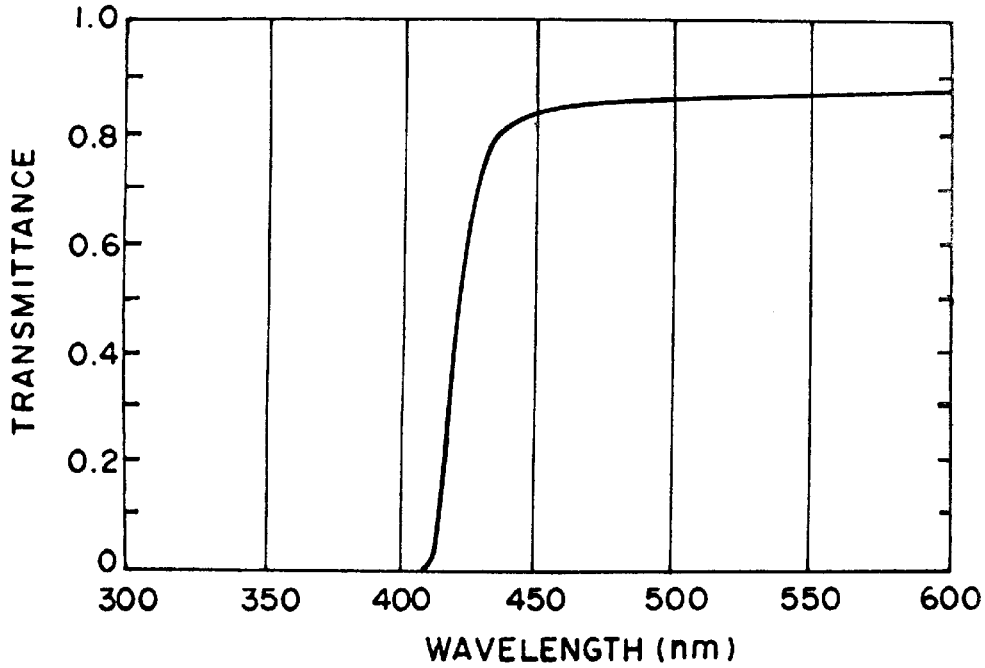
FIG. 11 is a transmission spectrum of a charge transport layer film for use in a photoconductor No. 4 fabricated in Example I-4.
Figure 12:
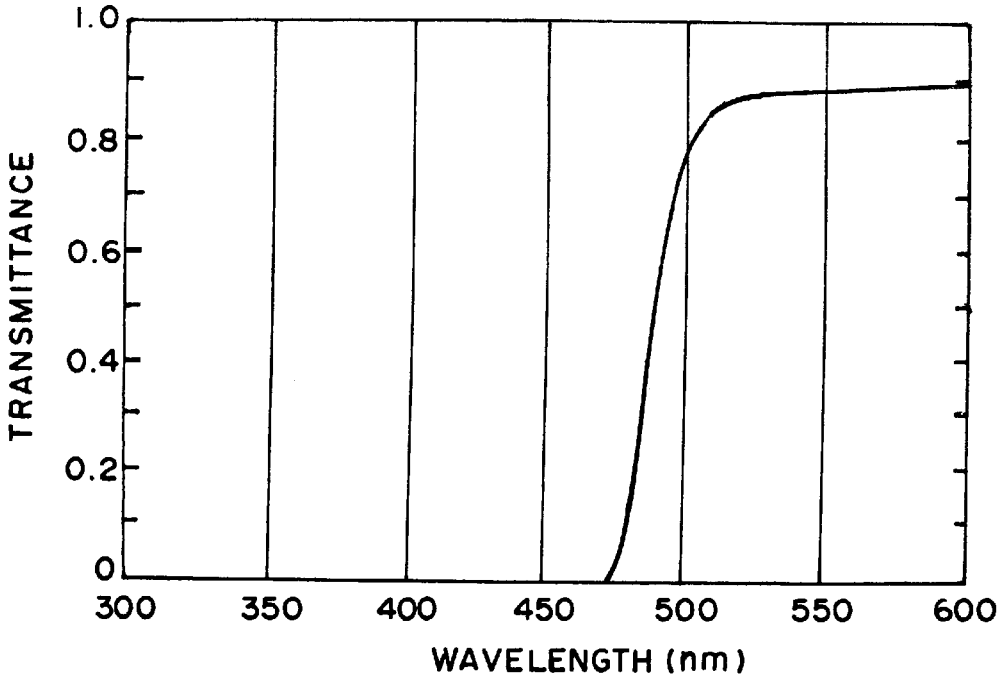
FIG. 12 is a transmission spectrum of a charge transport layer film for use in a photoconductor No. 5 fabricated in Comparative Example I-1.
Figure 13:
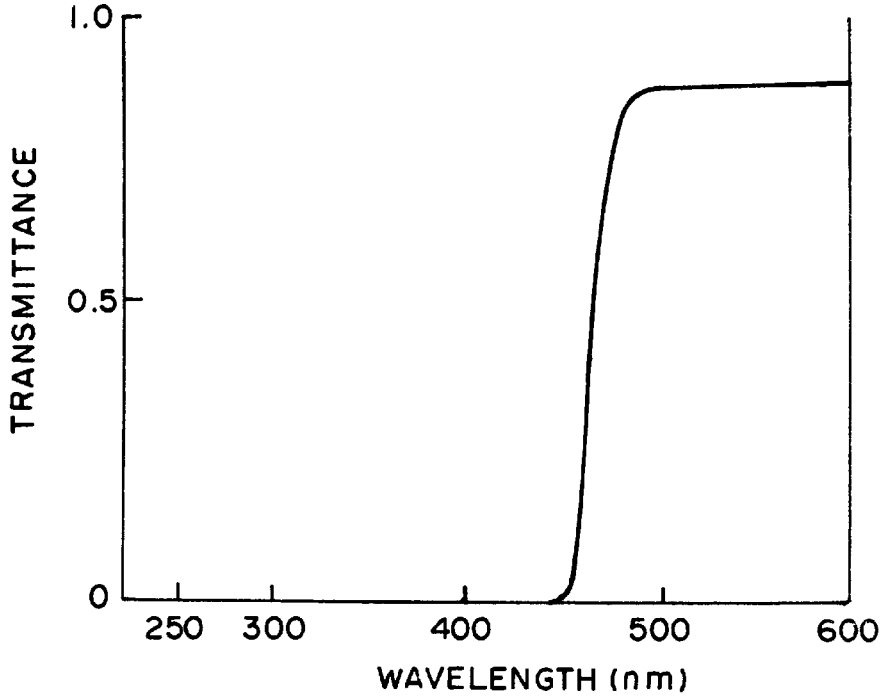
FIG. 13 is a transmission spectrum of a charge transport layer film for use in a photoconductor No. 6 fabricated in Comparative Example I-2.
Figure 14:
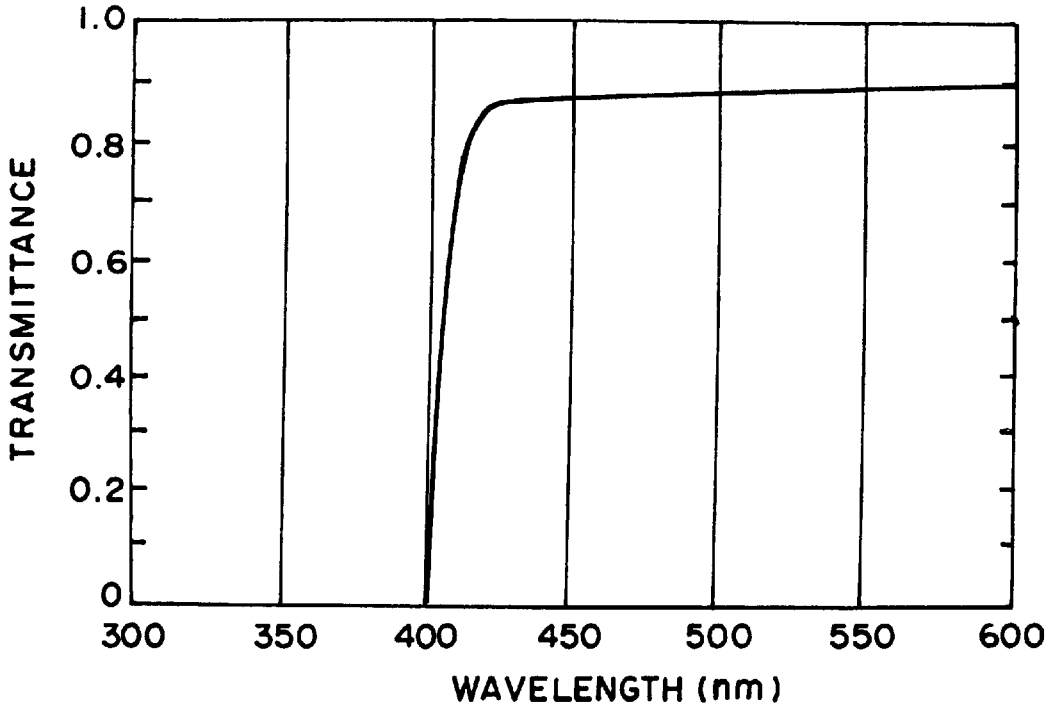
FIG. 14 is a transmission spectrum of a charge transport layer film for use in a photoconductor No. 7 fabricated in Example I-5.

FIG. 7 is a schematic view which shows one example of the process cartridge according to the present invention. In this process cartridge of FIG. 7, a charger 17, a light exposure unit 19, a development roller 20, and a cleaning brush 18 are disposed around a photoconductor 16. The photoconductor 16 comprises a photoconductive layer comprising a charge generation layer and a charge transport layer, which are successively provided on an electroconductive support.

Other features of this invention will become apparent in the course of the following description of exemplary embodiments, which are given for illustration of the invention and are not intended to be limiting thereof.

EXAMPLE I-1

[Fabrication of Electrophotographic Photoconductor No. 1]

<Formation of undercoat layer>

A mixture of the following components was subjected to ball-milling in a ball mill pot for 48 hours together with alumina balls having a diameter of 10 mm, thereby preparing a coating liquid for an undercoat layer:

| | Parts by weight |
|---|---|
| Oil free alkyd resin "Beckolite M6401" (Trademark), made by Dainippon Ink & Chemicals, Incorporated | 1.5 |
| Melamine resin "Super Beckamine G-821", (Trademark) made by Dainippon Ink & Chemicals, Incorporated | 1 |
| Titanium dioxide "Tipaque CR-EL" (Trademark), made by Ishihara Sangyo Kaisha, Ltd. | 5 |
| 2-butanone | 22.5 |

The thus prepared coating liquid was coated on the outer surface of an aluminum cylinder by dip coating, and dried at 130° C. for 20 minutes. Thus, an undercoat layer with a thickness of about 3.5 μm was provided on the aluminum cylinder.

<Formation of charge generation layer>

7.5 parts by weight of a bisazo compound with the following formula (72) and 500 parts by weight of a 0.5% cyclohexanone solution containing 2.5 parts by weight of a vinyl butyral resin (Trademark "XYHL", made by Union Carbide Japan K.K.) were pulverized and dispersed in a ball mill to prepare a coating liquid for a charge generation layer.

(72)

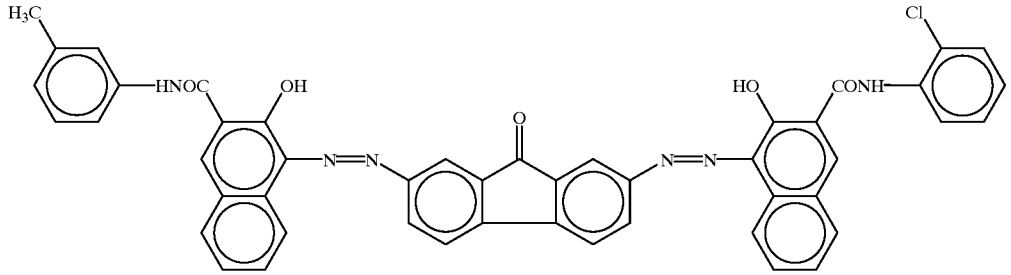

The thus obtained coating liquid was coated on the above prepared undercoat layer by dip coating, and dried at room temperature, so that a charge generation layer with a thickness of about 0.5 μm was provided on the undercoat layer.

<Formation of charge transport layer>

7 parts by weight of an aminobiphenyl compound with the following formula (73) having a fluorescence generation efficiency of 0.28 and 10 parts by weight of a polycarbonate resin (Trademark "Panlite TS-2050", made by Teijin Limited) were dissolved in tetrahydrofuran (THF) to prepare a coating liquid for a charge transport layer.

(73)

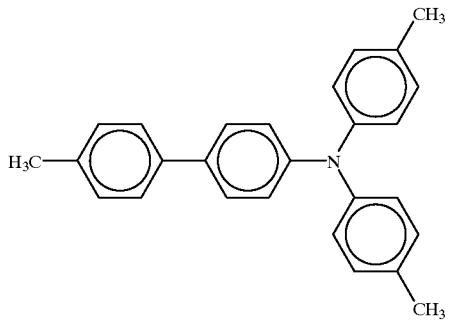

The thus obtained coating liquid was coated on the above prepared charge generation layer, and dried at 80° C. for 2 minutes and then 130° C. for 20 minutes, so that a charge transport layer with a thickness of about 20 μm was provided on the charge generation layer.

Thus, an electrophotographic photoconductor No. 1 according to the present invention was fabricated.

EXAMPLE I-2

The procedure for fabrication of the electrophotographic photoconductor No. 1 in Example I-1 was repeated except that the aminobiphenyl compound of formula (73) serving as a charge transport material for use in the charge transport layer coating liquid in Example I-1 was replaced by a compound of formula (74).

(74)

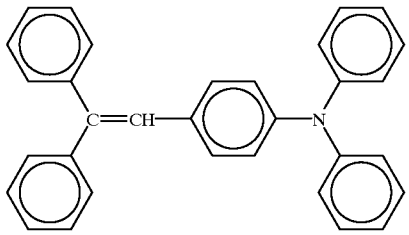

Thus, an electrophotographic photoconductor No. 2 according to the present invention was fabricated.

EXAMPLE I-3

The procedure for fabrication of the electrophotographic photoconductor No. 1 in Example I-1 was repeated except that the aminobiphenyl compound of formula (73) serving as a charge transport material for use in the charge transport layer coating liquid in Example I-1 was replaced by a compound of formula (75).

(75)

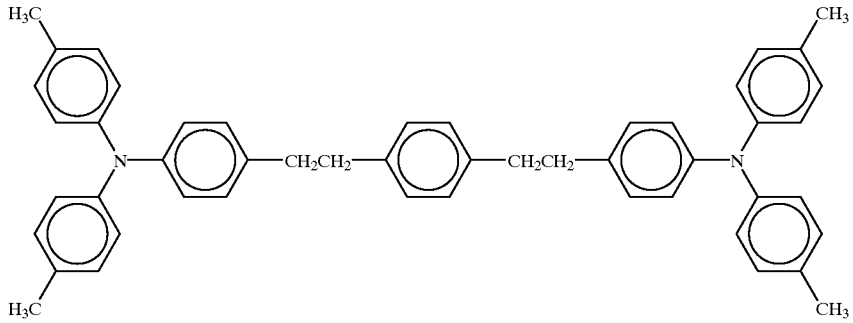

Thus, an electrophotographic photoconductor No. 3 according to the present invention was fabricated.

EXAMPLE I-4

The procedure for fabrication of the electrophotographic photoconductor No. 1 in Example I-1 was repeated except that the aminobiphenyl compound of formula (73) serving as a charge transport material for use in the charge transport layer coating liquid in Example I-1 was replaced by a compound of formula (76).

(76)

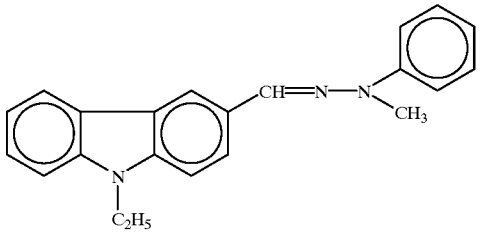

Thus, an electrophotographic photoconductor No. 4 according to the present invention was fabricated.

Comparative Example I-1

The procedure for fabrication of the electrophotographic photoconductor No. 1 in Example I-1 was repeated except that the aminobiphenyl compound of formula (73) serving as a charge transport material for use in the charge transport layer coating liquid in Example I-1 was replaced by a compound of formula (77).

(77)

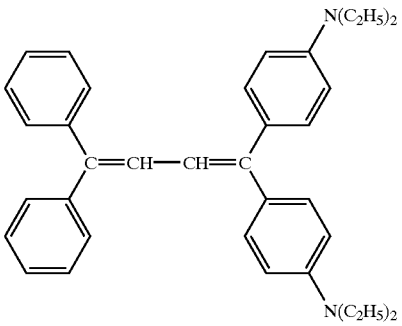

Thus, an electrophotographic photoconductor No. 5 for comparison was fabricated.

Comparative Example I-2

The procedure for fabrication of the electrophotographic photoconductor No. 1 in Example I-1 was repeated except that the aminobiphenyl compound of formula (73) serving as a charge transport material for use in the charge transport layer coating liquid in Example I-1 was replaced by a compound of formula (78).

(78)

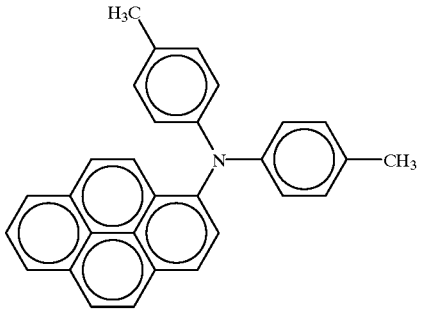

Thus, an electrophotographic photoconductor No. 6 for comparison was fabricated.

EXAMPLE I-5

The procedure for fabrication of the electrophotographic photoconductor No. 1 in Example I-1 was repeated except that the aminobiphenyl compound of formula (73) serving as a charge transport material for use in the charge transport layer coating liquid in Example I-1 was replaced by a compound of formula (79).

(79)

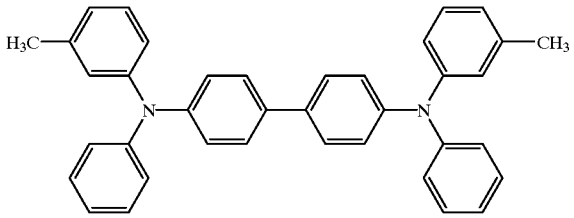

Thus, an electrophotographic photoconductor No. 7 according to the present invention was fabricated.

[Measurement of Light Transmitting Properties of Charge Transport Layer]

The charge transport layer coating liquids employed in Examples I-1 to I-5 and Comparative Examples I-1 and I-2 were separately applied to the surface of a polyester film to provide a charge transport layer film under the same conditions as indicated in Example I-1.

A charge transport layer film was peeled from the polyester film, and the transmission spectrum of each charge transport layer film was measured using a spectrophotometer. The light transmitting properties at each wavelength, that is, 450, 440, 435, 420, or 405 nm, was obtained in accordance with the previously mentioned formula (B). The results are shown in TABLE 1.

The transmission spectra of the charge transport layer films for use in the photoconductors No. 1 to 7 are shown in FIG. 8 to FIG. 14, respectively.

[Measurement of Fluorescence Generation Efficiency of Charge Transport Layer]

The fluorescence generation efficiency of each charge transport layer film was obtained in the same manner as described in Japanese Laid-Open Patent Application 5-61216 and Japan Hard Copy '91, pp. 165–168. To be more specific, each charge transport layer film, which was provided with many notches, was irradiated with monochromatic light in a wavelength region of 400 to 450 nm using a commercially available spectrophotometer ("Model 228" made by Hitachi, Ltd.) Fluorescence given off from the charge transport layer film was collected by use of an integrating sphere. The number of photons in the incident monochromatic light and the number of photons at a peak in the fluorescence spectrum were calculated, and the ratio was expressed as a fluorescence generation efficiency.

[Evaluation of Spectral Sensitivity of Photoconductor]

The spectral sensitivity of each of the photoconductors fabricated in Examples I-1 to I-5 and Comparative Examples I-1 and I-2 was measured within a wavelength region of an LD, namely, from 405 to 450 nm.

Each photoconductor was charged negatively to −800 V or more by corona charging, and the charging was stopped. The charged surface of each photoconductor was exposed to each monochromatic light of xenon lamp, which was obtained by a commercially available monochromator made by Nikon Corporation. The time required to reduce the initial surface potential, that is, −800 V, to −100 V was measured. The exposure ($\mu J/cm^2$) was calculated from the light intensity ($\mu W/cm^2$). The spectral sensitivity ($V \cdot cm^2/\mu J$) was expressed by dividing the difference in potential by light decay, i.e., 700 V, by the above-mentioned value of exposure. However, the surface potential decreased by dark decay before the light decay in practice. Therefore, a decrease in surface potential by the dark decay was obtained prior to the measurement of the spectral sensitivity, and the obtained spectral sensitivity was calibrated using the above-mentioned decrease in surface potential by the dark decay. TABLE 1 also shows the results of the measurement of spectral sensitivities.

TABLE 1

| Example No. | Photo-conductor No. | Fluorescence Generation Efficiency | | Wavelength of Monochromatic Light (nm) 450 | 440 | 435 | 420 | 405 |
|---|---|---|---|---|---|---|---|---|
| Ex. I-1 | 1 | 0.28 | Light transmitting properties (%) | 99 | 99 | 98 | 98 | 94 |
| | | | Spectral sensitivity ($V \cdot cm^2/\mu J$) | 1523 | 1485 | 1478 | 1365 | 1105 |
| Ex. I-2 | 2 | 0.23 | Light transmitting properties (%) | 92 | 69 | 48 | 0 | 0 |
| | | | Spectral sensitivity ($V \cdot cm^2/\mu J$) | 1366 | 1072 | 740 | 707 | 675 |

TABLE 1-continued

| Example No. | Photo-conductor No. | Fluorescence Generation Efficiency | | Wavelength of Monochromatic Light (nm) 450 | 440 | 435 | 420 | 405 |
|---|---|---|---|---|---|---|---|---|
| Ex. I-3 | 3 | 0.05 | Light transmitting properties (%) | 99 | 99 | 99 | 99 | 97 |
| | | | Spectral sensitivity ($V \cdot cm^2/\mu J$) | 1166 | 1125 | 1112 | 1046 | 920 |
| Ex. I-4 | 4 | 0.02 | Light transmitting properties (%) | 97 | 94 | 90 | 43 | 0 |
| | | | Spectral sensitivity ($V \cdot cm^2/\mu J$) | 1239 | 1201 | 1127 | 452 | — |
| Comp. Ex. I-1 | 5 | 0.006 | Light transmitting properties (%) | 0 | 0 | 0 | 0 | 0 |
| | | | Spectral sensitivity ($V \cdot cm^2/\mu J$) | — | — | — | — | — |
| Comp. Ex. I-2 | 6 | 0.83 | Light transmitting properties (%) | 0.04 | 0.02 | 0 | 0 | 0 |
| | | | Spectral sensitivity ($V \cdot cm^2/\mu J$) | 1433 | 1355 | 1372 | 1202 | 1005 |
| Ex. I-5 | 7 | 0.41 | Light transmitting properties (%) | 0.98 | 0.98 | 0.98 | 0.97 | 0.05 |
| | | | Spectral sensitivity ($V \cdot cm^2/\mu J$) | 1471 | 1429 | 1423 | 1321 | 873 |

In TABLE 1, "–" means no sensitivity.

As can be seen from the results shown in TABLE 1, the charge transport layers of the photoconductors No. 1 and No. 3 according to the present invention (fabricated in Examples I-1 and I-3) exhibit light transmission properties as high as 90% or more throughout the wavelength region from 400 to 450 nm, and therefore, the photoconductors No. 1 and No. 3 show high sensitivity as a whole.

The photoconductors No. 2, No. 4, and No. 7 according to the present invention (fabricated in Examples I–2, I–4, and I-5) exhibit relatively high spectral sensitivities throughout the wavelength region due to the sensitization by fluorescence although the light transmitting properties are particularly low at the shorter wavelength side. The fluorescence generation efficiency of the photoconductor No. 4 is as low as 0.02. Therefore, when the light transmitting properties lower to 50% or less, the spectral sensitivities become considerably poor because the sensitization by fluorescence is not expected.

In contrast to the above, the photoconductor No. 5 (fabricated in Comparative Example I-1) do not transmit any monochromic light with wavelengths of 405 to 450 nm. The charge transport layer of the photoconductor No. 5 exhibits a remarkably low fluorescence generation efficiency, i.e., 0.006, so that no sensitivity is obtained within the above-mentioned wavelength region.

The charge transport layer of the photoconductor No. 6 (fabricated in Comparative Example I-2) has a fluorescence generation efficiency of as high as 0.83. Therefore, although any monochromatic light with wavelengths of 435 nm or less is not allowed to pass through the charge transport layer of the photoconductor No. 6, the sensitivity is sufficiently high within the wavelength region of 400 to 450 nm. This is because the charge transport material is optically excited upon absorption of light, and thereafter get inactivated as emitting fluorescence, which is absorbed by the charge generation material.

EXAMPLE I-6

[Fabrication of Electrophotographic Photoconductor No. 8]

<Formation of undercoat layer>

A mixture of the following components was subjected to ball-milling in a ball mill pot for 48 hours together with alumina balls having a diameter of 10 mm, thereby preparing a coating liquid for an undercoat layer:

| | Parts by weight |
|---|---|
| Oil free alkyd resin "Beckolite M6401" (Trademark), made by Dainippon Ink & Chemicals, Incorporated | 1.5 |
| Melamine resin "Super Beckamine G-821", (Trademark) made by Dainippon Ink & Chemicals, Incorporated | 1 |
| Titanium dioxide "Tipaque CR-EL" (Trademark), made by Ishihara Sangyo Kaisha, Ltd. | 5 |
| 2-butanone | 22.5 |

The thus prepared coating liquid was coated on the outer surface of an aluminum cylinder by dip coating, and dried at 130° C. for 20 minutes. Thus, an undercoat layer with a thickness of about 3.5 $\mu$m was provided on the aluminum cylinder.

<Formation of charge generation layer>

7.5 parts by weight of a bisazo compound with the following formula (72) and 500 parts by weight of a 0.5% cyclohexanone solution containing 2.5 parts by weight of a vinyl butyral resin (Trademark "XYHL", made by Union Carbide Japan K.K.) were pulverized and dispersed in a ball mill to prepare a coating liquid for a charge generation layer.

(72)

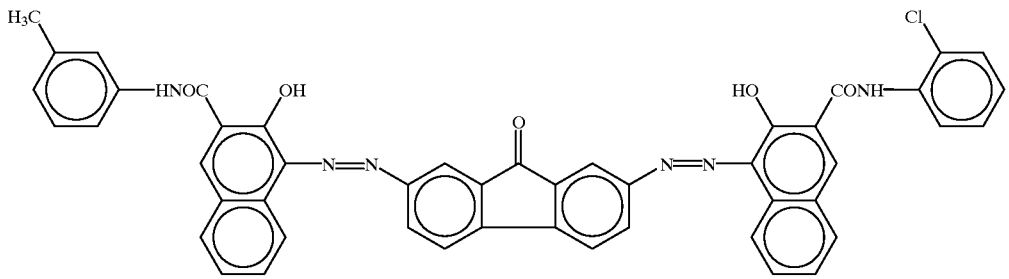

The thus obtained coating liquid was coated on the above prepared undercoat layer by dip coating, and dried at room temperature, so that a charge generation layer with a thickness of about 0.5 μm was provided on the undercoat layer.

<Formation of first charge transport layer>

7 parts by weight of an aminobiphenyl compound with the following formula (73) having a fluorescence generation efficiency of 0.28 and 10 parts by weight of a polycarbonate resin (Trademark "Panlite TS-2050", made by Teijin Limited) were dissolved in tetrahydrofuran (THF) to prepare a coating liquid for a first charge transport layer.

(73)

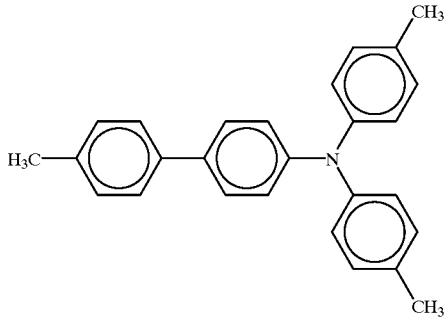

The thus obtained coating liquid was coated on the above prepared charge generation layer, and dried at 80° C. for 2 minutes and then 130° C. for 20 minutes, so that a first charge transport layer with a thickness of about 20 μm was provided on the charge generation layer.

<Formation of second charge transport layer>

The following components were mixed to prepare a coating liquid for a second charge transport layer:

| | Parts by Weight |
|---|---|
| Polycarbonate resin "Panlite TS-2050" (Trademark), made by Teijin Limited | 5 |
| Titanium oxide fine powder "CR97" (Trademark), made by Ishihara Sangyo Kaisha, Ltd. (serving as a filler) | 2 |
| Aminobiphenyl compound with formula (73) | 3 |

-continued

| | Parts by Weight |
|---|---|
| (73) 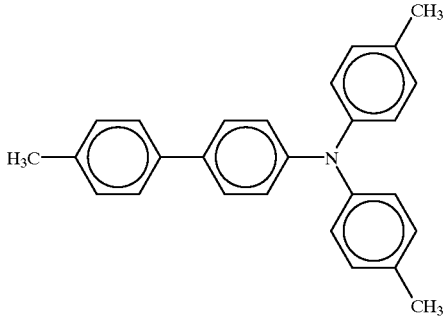 | |
| Tetrahydrofuran | 40 |
| Cyclohexanone | 140 |

The thus obtained coating liquid was coated on the above prepared first charge transport layer by spray coating, and dried at 80° C. for 2 minutes and then 130° C. for 20 minutes, so that a second charge transport layer with a thickness of about 5 μm was provided on the first charge transport layer.

Thus, an electrophotographic photoconductor No. 8 according to the present invention was fabricated.

EXAMPLE I-7

The procedure for fabrication of the electrophotographic photoconductor No. 8 in Example I-6 was repeated except that the aminobiphenyl compound of formula (73) used in the first and second charge transport layer coating liquids in Example I-6 was replaced by the compound of the following formula (75);

(75)

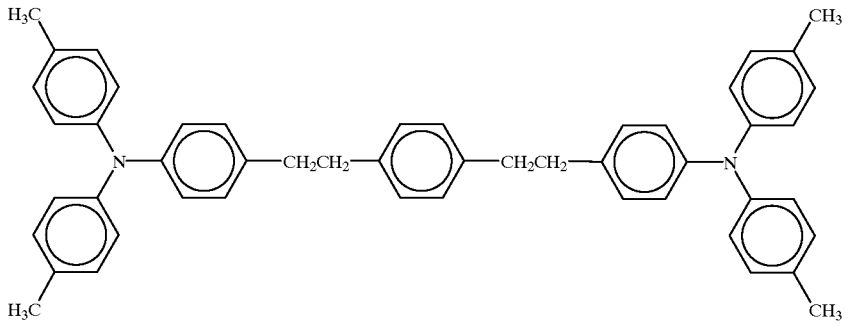

Thus, an electrophotographic photoconductor No. 9 according to the present invention was fabricated.

EXAMPLE I-8

The procedure for fabrication of the electrophotographic photoconductor No. 8 in Example I-6 was repeated except that the formulation for the coating liquid of second charge transport layer was changed to the following formulation:

| | Parts by Weight |
|---|---|
| Polycarbonate resin "Panlite C-1400" (Trademark), made by Teijin Limited | 7 |
| Silica fine powder "MPX100" (Trademark), made by Shin-Etsu Chemical Co., Ltd. (serving as a filler) | 2 |
| Dichloromethane | 200 |

Thus, an electrophotographic photoconductor No. 10 according to the present invention was fabricated.

EXAMPLE I-9

[Fabracation of Electrophotographic Photoconductor No. 11]

<Formation of undercoat layer>

A mixture of the following components was subjected to ball-milling in a ball mill pot for 48 hours together with alumina balls having a diameter of 10 mm, thereby preparing a coating liquid for an undercoat layer:

| | Parts by weight |
|---|---|
| Oil free alkyd resin "Beckolite M6401" (Trademark), made by Dainippon Ink & Chemicals, Incorporated | 1.5 |
| Melamine resin "Super Beckamine G-821" (Trademark), made by Dainippon Ink & Chemicals, Incorporated | 1 |
| Titanium dioxide "Tipaque CR-EL" (Trademark) made by Ishihara Sangyo Kaisha, Ltd. | 5 |
| 2-butanone | 22.5 |

The thus prepared coating liquid was coated on the outer surface of an aluminum cylinder by dip coating, and dried at 130° C. for 20 minutes. Thus, an undercoat layer with a thickness of about 3.5 μm was provided on the aluminum cylinder.

<Formation of charge generation layer>

1.5 parts by weight of a Y-type oxotitanium phthalocyanine compound and 500 parts by weight of a 0.5% dichloromethane solution containing one part by weight of a polyester resin (Trademark "Vylon 200", made by Toyobo Co., Ltd.) were pulverized and dispersed in a ball mill to prepare a coating liquid for a charge generation layer.

The thus obtained coating liquid was coated on the above prepared undercoat layer by dip coating and dried at room temperature, so that a charge generation layer with a thickness of about 0.3 μm was provided on the undercoat layer.

<Formation of first charge transport layer>

7 parts by weight of an aminobiphenyl compound, serving as a charge transport material, represented by the following formula (80), and 10 parts by weight of a polycarbonate resin (Trademark "Panlite C-1400", made by Teijin Limited) were dissolved in tetrahydrofuran to prepare a coating liquid for a first charge transport layer.

(80)

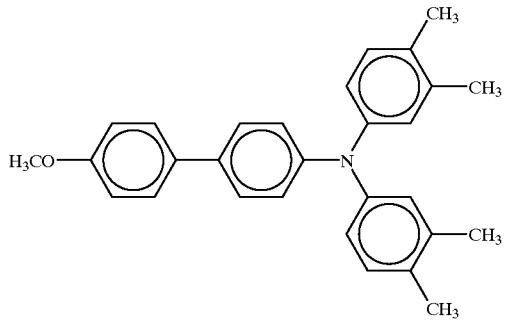

The thus obtained coating liquid was coated on the above prepared charge generation layer by dip coating, and dried at 80° C. for 2 minutes and then 130° for 20 minutes, so that a first charge transport layer with a thickness of about 20 μm was provided on the charge generation layer.

<Formation of second charge transport layer>

7 parts by weight of a high-molecular weight charge transport material in the form of a random copolymer, represented by the following formula (81), 3 parts by weight of an alumina fine powder (Trademark "Alumina-C", made by Nippon Aerosil Co., Ltd.) serving as a filler, 40 parts by weight of tetrahydrofuran, and 140 parts by weight of cyclohexanone were mixed to prepare a coating liquid for a second charge transport layer.

(81)

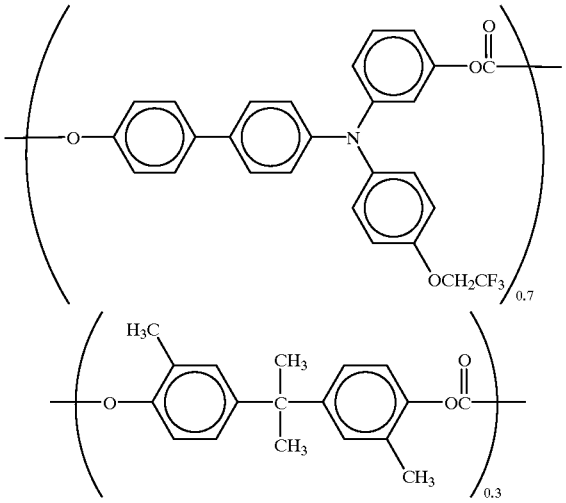

The thus obtained coating liquid was coated on the above prepared first charge transport layer by spray coating, and dried at 80° C. for 2 minutes and then 160° C. for 20 minutes, so that a second charge transport layer with a thickness of about 3 μm was provided on the first charge transport layer.

Thus, an electrophotographic photoconductor No. 11 according to the present invention was fabricated.

Comparative Example I-3

The procedure for fabrication of the electrophotographic photoconductor No. 8 in Example I-6 was repeated except that the aminobiphenyl compound of formula (73) used as the charge transport material in the first and second charge transport layer coating liquids in Example I-6 was replaced by the butadiene compound of formula (77).

(77)

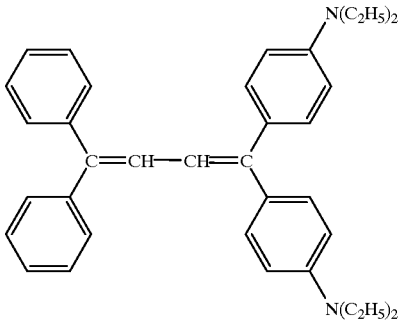

Thus, an electrophotographic photoconductor No. 12 for comparison was fabricated.

[Measurement of Light Transmitting Properties of Charge Transport Layer]

A two-layered charge transport layer film was individually provided on a polyester film as stated above, using the combination of the first charge transport layer coating liquid and the second charge transport layer coating liquid employed in each of Examples I-6 to I-9 and Comparative Example I-3.

A two-layered charge transport layer film was peeled from the polyester film, and the transmission spectrum of each charge transport layer film was measured using a spectrophotometer. The light transmitting properties at each wavelength, that is, 450, 440, 435, 420, and 400 nm, was obtained in accordance with the previously mentioned formula (B). The results are shown in TABLE 2.

[Evaluation of Spectral Sensitivity of Photoconductor]

The spectral sensitivity of each of the photoconductors No. 8 to 12 was measured in the same manner as described above. The results are also shown in TABLE 2.

TABLE 2

| Example No. | Photoconductor No. | | Wavelength of Monochromatic Light (nm) 450 | 440 | 435 | 420 | 400 |
|---|---|---|---|---|---|---|---|
| Ex. I-6 | 8 | Light transmitting properties (%) | 89 | 88 | 86 | 82 | 76 |
| | | Spectral sensitivity ($V \cdot cm^2/\mu J$) | 1417 | 1388 | 1317 | 1256 | 964 |
| Ex. I-7 | 9 | Light transmitting properties (%) | 89 | 88 | 84 | 81 | 77 |
| | | Spectral sensitivity ($V \cdot cm^2/\mu J$) | 1088 | 1044 | 1012 | 902 | 799 |
| Ex. I-8 | 10 | Light transmitting properties (%) | 89 | 87 | 81 | 81 | 75 |
| | | Spectral sensitivity ($V \cdot cm^2/\mu J$) | 1189 | 1131 | 1105 | 987 | 856 |
| Ex. I-9 | 11 | Light transmitting properties (%) | 85 | 84 | 82 | 77 | 42 |
| | | Spectral sensitivity ($V \cdot cm^2/\mu J$) | 1165 | 1112 | 1048 | 652 | — |
| Comp. Ex. I-3 | 12 | Light transmitting properties (%) | 0 | 0 | 0 | 0 | 0 |
| | | Spectral sensitivity ($V \cdot cm^2/\mu J$) | — | — | — | — | — |

In TABLE 2, "–" means no sensitivity.

As can be seen from the results shown in TABLE 2, any charge transport layers of the photoconductors No. 8 to No. 10 according to the present invention (fabricated in Examples I-6 to I-8) exhibit good light transmitting properties throughout the wavelength region of 400 to 450 nm, and therefore, high spectral sensitivities can be obtained.

In contrast to this, the charge transport layer of the photoconductor No. 12 (fabricated in Comparative Example I-3) does not transmit any monochromatic light with wavelengths of 400 to 450 nm. Consequently, the photoconductor No. 12 shows no sensitivity throughout this wavelength region similar to the photoconductor No. 5.

In view of the above, the charge transport layer is required to show high light transmitting properties with respect to light applied to the photoconductor for the formation of latent images. Even if the light transmitting properties are very low, high sensitivity can be obtained through the sensitization by fluorescence. However, an excessively large fluorescence generation efficiency results in poor resolution of the obtained image and poor repetition stability of the photoconductor, as described above.

Accordingly, in order to ensure high sensitivity of the electrophotographic photoconductor and to produce images with high resolution using a light source such as a blue to purple semiconductor laser or light emitting diode (LED), it is important that the charge transport layer have high light transmitting properties and a low fluorescence generation efficiency, that is, 0.8 or less, with respect to the above-mentioned light source for the formation of latent images.

EXAMPLE I-10

[Fabrication of Electrophotographic Photoconductor No. 13]

<Formation of undercoat layer>

The following components were mixed to prepare a coating liquid for an undercoat layer;

| | Parts by weight |
|---|---|
| Titanium dioxide "TA-300" (Trademark), made by Ishihara Sangyo Kaisha, Ltd. | 5 |
| Copolymer polyamide resin "CM-8000", made by Toray Industries, Inc. | 4 |
| Methanol | 50 |
| Isopropanol | 20 |

The thus prepared coating liquid was coated on the outer surface of an electroforming nickel endless belt, and dried. Thus, an undercoat layer with a thickness of about 4 $\mu$m was provided.

<Formation of charge generation layer>

The following components were mixed to prepare a coating liquid for charge generation layer:

| | Parts by Weight |
|---|---|
| Y-type oxotitanium phthalocyanine pigment powder | 4 |
| Poly(vinyl butyral) | 2 |
| Cyclohexanone | 50 |
| Tetrahydrofuran | 100 |

The thus obtained coating liquid was coated on the above prepared undercoat layer and dried to provide a charge generation layer with a thickness of about 0.3 $\mu$m on the undercoat layer.

[Formation of first charge transport layer]

The following components were mixed to prepare a coating liquid for first charge transport layer:

| | Parts by Weight |
|---|---|
| Polycarbonate resin (Trademark "Panlite TS-2050", made by Teijin Limited) | 10 |
| Charge transport material with formula (72): | 9 |

(72)

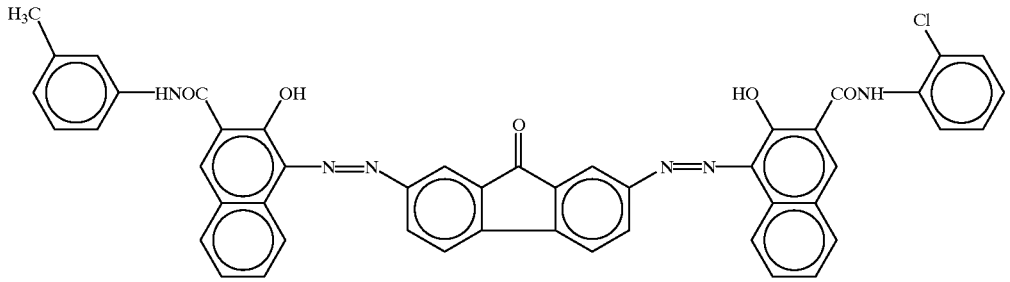

| | |
|---|---|
| Tetrahydrofuran | 80 |

The thus prepared coating liquid was coated on the above prepared charge generation layer and dried to provide a first charge transport layer with a thickness of 27.0 μm on the charge generation layer.

[Formation of second charge transport layer]

The following components were mixed to prepare a coating liquid for second charge transport layer:

| | Parts by Weight |
|---|---|
| Polycarbonate resin (Trademark "Panlite TS-2050", made by Teijin Limited) | 5 |
| Charge transport material with formula (72) | 3 |
| Finely-divided particles of alumina (Trademark "Alumina-C" made by Nippon Aerosil Co., Ltd.) | 2 |
| Tetrahydrofuran | 80 |

(72)

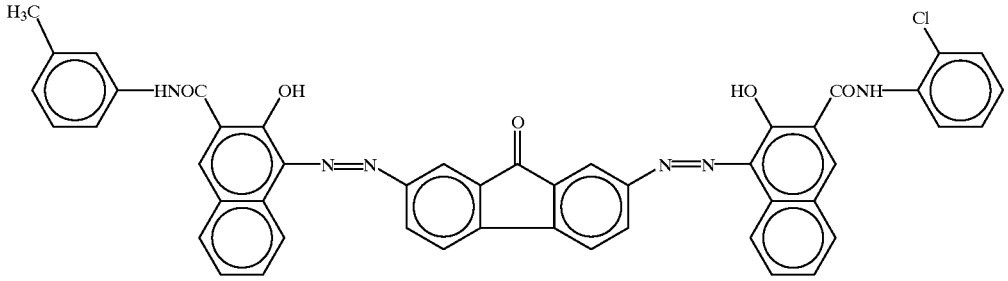

The thus prepared coating liquid was coated on the above prepared first charge transport layer and dried to provide a second charge transport layer with a thickness of 3.0 μm on the first charge transport layer.

Thus, an electrophotographic photoconductor No. 13 according to the present invention was fabricated.

EXAMPLE II-1

[Fabrication of Electrophotographic Image Forming Apparatus No. 1]

The electrophotographic photoconductor No. 1 (fabricated in Example I-1) in the form of a drum was incorporated in a process cartridge of a commercially available copying machine "IMAGIO MF2200" (Trademark), made by Ricoh Company, Ltd., capable of producing images with a resolution of 600 dpi. This copying machine was modified in such a way that LDs of 405 nm, 435 nm, and 450 nm were set as light sources for image exposure, and the light source was easily switched by an external LD driving device. Thus, an electrophotographic image forming apparatus No. 1 according to the present invention was obtained.

EXAMPLES II-2 TO II-10 AND COMPARATIVE EXAMPLE II-1

The procedure for fabrication of the electrophotographic image forming apparatus No. 1 in Example II-1 was repeated except that the electrophotographic photoconductor No. 1 incorporated in the process cartridge was replaced by the respective photoconductors shown in TABLE 3.

Each of the electrophotographic image forming apparatuses (fabricated in Examples II-1 to II-10 and Comparative Example II-1) was subjected to an image formation test. To be more specific, the initial surface potential of a non-light exposed portion was set at about −700 V and the initial surface potential of a light-exposed portion was set at about −100 V. After 10,000 copies were continuously made, the surface potentials of both the non-light exposed portion and the light-exposed portion were measured. The results are shown in TABLE 3.

A dot image was independently formed in one space and the resolution of the dot image was evaluated. The results are also shown in TABLE 3.

TABLE 3

| | Photoconductor No. | Wavelength of Light Source (nm) | Surface potential after making of 10,000 copies: Non-light exposed portion (V) | Surface potential after making of 10,000 copies: Light-exposed portion (V) | Dot reproducibility (*): Initial stage | Dot reproducibility (*): After 10,000 copies |
|---|---|---|---|---|---|---|
| Ex. II-1 | 1 | 405 | −710 | −105 | ○ | ○ |
| Ex. II-2 | 2 | 450 | −690 | −125 | ○ | ○ |
| Ex. II-3 | 3 | 435 | −705 | −90 | ○ | ○ |
| Ex. II-4 | 4 | 450 | −695 | −95 | ○ | ○ |
| Ex. II-5 | 7 | 435 | −685 | −115 | ○ | Δ |
| Ex. II-6 | 1 | 450 | −685 | −100 | ○ | ○ |
| Ex. II-7 | 8 | 405 | −700 | −115 | ○ | ○ |
| Ex. II-8 | 9 | 450 | −690 | −140 | ○ | ○ |
| Ex. II-9 | 10 | 405 | −715 | −125 | ○ | ○ |
| Ex. II-10 | 11 | 435 | −695 | −120 | ○ | ○ |
| Comp. Ex. II-1 | 6 | 450 | −520 | −350 | X | X |

(*) Dot reproducibility
○: Very sharp dot image
Δ: sharp dot image (acceptable)
X: Not reproduced As can be seen from the results shown in TABLE 3, the electrophotographic image forming apparatus fabricated in Examples II-1 to II-10 are excellent in stability of charging characteristics in the repeated operations, and the reproducibility of a dot image.

On the other hand, the photoconductor No. 6 used in Comparative Example II-1 shows low light transmitting properties to the light source, and in addition, a high fluorescence generation efficiency, so that the surface potential greatly changes in the repeated use, and the reproducibility of a dot image is poor even at the initial stage.

The photoconductors No. 5 and No. 12 were not subjected to the image formation test because no sensitivity was obtained within the above-mentioned wavelength region.

EXAMPLE II-11

[Fabrication of Electrophotographic Image Forming Apparatus No. 11]

The electrophotographic photoconductor No. 13 in the form of an endless belt, fabricated in Example I-10, was incorporated in an electrophotographic image forming apparatus shown in FIG. 5. As a light source for an image exposure unit, a semiconductor laser with a wavelength of 405 nm was employed to write a latent image on the photoconductor through a polygon mirror. For measuring the surface potential of the photoconductor immediately before a development step, a probe of a surface potentiometer was inserted into the surface of the photoconductor No. 13.

After 100,000 copies were continuously made, the surface potentials of a non-light-exposed portion and a light-exposed portion were measured. The results are shown in TABLE 4.

TABLE 4

| Surface Potential after 100,000 Copies | | Dot Reproducibility | |
|---|---|---|---|
| Non-light-exposed portion (V) | Light-exposed portion (V) | Initial stage | After making of 100,000 copies |
| −710 | −105 | ○ | ○ |

As is apparent from the results shown in TABLE 4, the electrophotographic image forming apparatus No. 11 also shows excellent stability in charging characteristics during repeated operations.

When the change in thickness of the second charge transport layer was measured after making of 100,000 copies, no change in thickness was observed.

[Measurement of Abrasion Loss of Charge Transport Layer]

The coating liquid for second charge transport layer used in the fabrication of each of the photoconductors No. 8 to No. 11 was applied to an aluminum substrate using a doctor blade, and dried at 80° C. for 2 minutes and then 130° C. for 20 minutes, whereby a second charge transport layer film with a thickness of about 5 $\mu$m was formed on the aluminum substrate. Thus, samples No. 1 to No. 4 were prepared.

A reference sample was prepared in the same manner as mentioned above except that the formulation for the second charge transport layer coating liquid was replaced as follows: 5 parts by weight of a polycarbonate resin (Trademark "Panlite TS-2050", made by Teijin Limited) and 3 parts by weight of the aforementioned aminobiphenyl compound of formula (73) were dissolved in a mixture of 40 parts by weight of tetrahydrofuran and 140 parts by weight of cyclohexanone.

Each sample was subjected to an abrasion test. Using a commercially available Taber abrader (made by Toyo Seiki Seisaku-Sho, Ltd.) with a truck wheel CS-5, the surface of each sample was abraded by 3,000 rotations at 60 rpm under the application of a load of 1 kg. The decrease in weight of the sample after the abrasion test was regarded as an abrasion loss (mg). The results are shown in TABLE 5.

TABLE 5

| Sample No. (Photoconductor No.) | Abrasion loss (mg) |
|---|---|
| No. 1 (Photoconductor No. 8) | 0.01 |
| No. 2 (Photoconductor No. 9) | 0.02 |
| No. 3 (Photoconductor No. 10) | 0.02 |
| No. 4 (Photoconductor No. 11) | 0.03 |
| Reference Sample | 4.56 |

As can be seen from the results shown in TABLE 5, the abrasion loss in the reference sample is more than any other samples No. 1 to No. 4. By adding a filler to the second charge transport layer, the abrasion resistance can increase, thereby promoting the mechanical durability of the obtained electrophotographic photoconductor.

Japanese Patent Application No. 2000-088446 filed Mar. 28, 2000, Japanese Patent Application No. 2000-208846 filed Jul. 10, 2000, and Japanese Patent Application No. 2000-312336 filed Oct. 12, 2000 are hereby incorporated by reference.

What is claimed is:

1. An electrophotographic photoconductor comprising an electroconductive support, a charge generation layer formed thereon, and a charge transport layer formed on said charge generation layer, said charge transport layer exhibiting light transmitting properties of 50% or more with respect to monochromatic light having a wavelength of 390 to 460 nm, and said charge transport layer exhibiting a fluorescence generation efficiency of 0.8 or less when irradiated with said monochromatic light.

2. The photoconductor as claimed in claim 1, wherein said charge transport layer exhibits light transmitting properties of 50% or more with respect to said monochromatic light with wavelengths of 390 to 460 nm and said fluorescence generation efficiency of 0.5 or less.

3. The photoconductor as claimed in claim 2, wherein said charge transport layer exhibits light transmitting properties of 90% or more with respect to said monochromatic light with wavelengths of 390 to 460 nm and said fluorescence generation efficiency of 0.3 or less.

4. The photoconductor as claimed in claim 1, wherein said charge transport layer comprises a charge transport material.

5. The photoconductor as claimed in claim 4, wherein said charge transport layer may further comprise a filler which is dispersed in said charge transport layer.

6. The photoconductor as claimed in claim 1, wherein said charge transport layer comprises a first charge transport layer which comprises a charge transport material and a second charge transport layer which comprises a filler and a binder resin, said first charge transport layer and said second charge transport layer being successively overlaid on said charge generation layer in that order.

7. The photoconductor as claimed in claim 1, wherein said charge transport layer comprises a first charge transport layer which comprises a charge transport material and a second charge transport layer which comprises a filler and a charge transport material, said first charge transport layer and said second charge transport layer being successively overlaid on said charge generation layer in that order.

8. The photoconductor as claimed in claim 5, wherein said filler comprises at least one compound selected from the group consisting of titanium oxide, tin oxide, zinc oxide, zirconium oxide, indium oxide, silicon nitride, calcium oxide, barium sulfate, indium-tin oxide, silica, colloidal silica, alumina, carbon black, finely-divided particles of a fluorine-containing resin, finely-divided particles of a polysiloxane resin, and finely-divided particles of a high-molecular weight charge transport material.

9. The photoconductor as claimed in claim 4, wherein said charge transport material comprises at least one low-molecular weight charge transport material.

10. The photoconductor as claimed in claim 4, wherein said charge transport material comprises at least one high-molecular weight charge transport material.

11. The photoconductor as claimed in claim 4, wherein said charge transport material comprises a low-molecular weight charge transport material and a high-molecular weight charge transport material.

12. A process cartridge which is freely attachable to an electrophotographic image forming apparatus and detachable therefrom, said process cartridge holding therein an electrophotographic photoconductor, and at least one means selected from the group consisting of a charging means for charging a surface of said photoconductor, a light exposure means for exposing said photoconductor to a light image to form a latent electrostatic image on said photoconductor, a development means for developing said latent electrostatic image to a visible image, an image transfer means for transferring said visible image formed on said photoconductor to an image receiving member, a cleaning means for cleaning said surface of said photoconductor, and a quenching means, wherein said electrophotographic photoconductor comprises an electroconductive support, a charge generation layer formed thereon, and a charge transport layer formed on said charge generation layer, said charge transport layer allowing any monochromatic light with wavelengths of 390 to 460 nm to pass, and said charge transport layer exhibiting a fluorescence generation efficiency of 0.8 or less when irradiated with said monochromatic light.

13. The process cartridge as claimed in claim 12, wherein said light exposure means employs as a light source a semiconductor laser or a light emitting diode with wavelengths of 400 to 450 nm.

14. An electrophotographic image forming apparatus comprising:

an electrophotographic photoconductor, means for charging a surface of said photoconductor, means for exposing said photoconductor to a light image to form a latent electrostatic image on said photoconductor, means for developing said latent electrostatic image to a visible image, and means for transferring said visible image formed on said photoconductor to an image receiving member, wherein said electrophotographic photoconductor comprises an electroconductive support, a charge generation layer formed thereon, and a charge transport layer formed on said charge generation layer, said charge transport layer allowing any monochromatic light with wavelengths of 390 to 460 nm to pass, and said charge transport layer exhibiting a fluorescence generation efficiency of 0.8 or less when irradiated with said monochromatic light.

15. The electrophotographic image forming apparatus as claimed in claim 14, wherein said light exposure means employs as a light source a semiconductor laser or a light emitting diode with wavelengths of 400 to 450 nm.

16. An electrophotographic image forming apparatus comprising:

an electrophotographic photoconductor, a charging unit configured to charge a surface of said photoconductor, a light exposure unit configured to expose said photoconductor to a light image to form a latent electrostatic image on said photoconductor, a development unit configured to develop said latent electrostatic image to a visible image, and a transferring unit configured to transfer said visible image formed on said photoconductor to an image receiving member, wherein said electrophotographic photoconductor comprises an electroconductive support, a charge generation layer formed thereon, and a charge transport layer formed on said charge generation layer, said charge transport layer allowing any monochromatic light with wavelengths of 390 to 460 nm to pass, and said charge transport layer exhibiting a fluorescence generation efficiency of 0.8 or less when irradiated with said monochromatic light.

17. The electrophotographic image forming apparatus as claimed in claim 16, wherein said light exposure unit employs as a light source a semiconductor laser or a light emitting diode with wavelengths of 400 to 450 nm.

* * * * *

UNITED STATES PATENT AND TRADEMARK OFFICE

CERTIFICATE OF CORRECTION

PATENT NO. : 6,492,079 B2
DATED : December 10, 2002
INVENTOR(S) : Tomoyuki Shimada et al.

It is certified that error appears in the above-identified patent and that said Letters Patent is hereby corrected as shown below:

Column 1,
Line 24, delete "inorgnaic" and insert -- inorganic --

Column 2,
Line 32, delete "reliabler" and insert -- reliable --

Column 4,
Line 29, delete "With" and insert -- with --
Line 43, delete "," and insert -- . --

Column 18,
Line 38, delete "phenylenedianine" and insert -- phenylenediamine --

Column 38,
Line 19, delete "Algal" and insert -- Algol --

Column 51,
Line 43, delete "Fabracation" and insert -- Fabrication --

Signed and Sealed this

Twenty-sixth Day of August, 2003

JAMES E. ROGAN
*Director of the United States Patent and Trademark Office*